US012429275B2

(12) United States Patent
Song

(10) Patent No.: US 12,429,275 B2
(45) Date of Patent: Sep. 30, 2025

(54) HOME APPLIANCE

(71) Applicant: LG Electronics Inc., Seoul (KR)

(72) Inventor: Seongmin Song, Seoul (KR)

(73) Assignee: LG Electronics Inc., Seoul (KR)

( * ) Notice: Subject to any disclaimer, the term of this patent is extended or adjusted under 35 U.S.C. 154(b) by 410 days.

(21) Appl. No.: 17/987,536

(22) Filed: Nov. 15, 2022

(65) Prior Publication Data

US 2023/0152028 A1 May 18, 2023

(30) Foreign Application Priority Data

Nov. 16, 2021 (KR) ..... 10-2021-0158031
Jan. 31, 2022 (KR) ..... 10-2022-0013836

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01); *F25D 2400/18* (2013.01)

(58) Field of Classification Search
CPC ... A47B 2096/208; A47B 96/20; F25D 23/02; F25D 23/028; F25D 2323/02; F25D 2400/18; F25D 2400/36; F25D 27/00; F25D 27/005
See application file for complete search history.

(56) References Cited

U.S. PATENT DOCUMENTS 8,789,900 B2 7/2014 Laible et al.
12,066,238 B2 * 8/2024 Kim ..... E06B 3/70
2009/0045705 A1 2/2009 Laible et al.
2009/0249824 A1 * 10/2009 Koo ..... F25D 23/065 62/449
2016/0117022 A1 * 4/2016 Kim ..... F24C 15/02 345/82
2018/0164030 A1 * 6/2018 Lee ..... F25D 27/00
2019/0257571 A1 * 8/2019 Park ..... E06B 3/70
2019/0307263 A1 * 10/2019 Lee ..... F25D 23/025
2021/0055038 A1 * 2/2021 Lee ..... F25C 5/22
2021/0071933 A1 * 3/2021 Lee ..... F25D 23/02
(Continued)

FOREIGN PATENT DOCUMENTS

CN 103250018 8/2013
CN 103250018 A * 8/2013 ..... F25D 27/00
KR 10-2018- 0067382 6/2018
(Continued)

OTHER PUBLICATIONS

Extended European Search Report in European Appln. No. 22207772.9, mailed on Apr. 4, 2023, 9 pages.

*Primary Examiner* — Andrew Roersma
(74) *Attorney, Agent, or Firm* — Fish & Richardson P.C.

(57) ABSTRACT

An appliance includes a cabinet in which a storage space is defined and a door configured to open and close the storage space. The door includes a door body and a panel assembly mounted on the door body. The panel assembly includes a panel that defines a front surface of the door and is configured to transmit light, a lighting device configured to allow the panel to shine with a set color, and a back cover configured to define a rear surface of the panel assembly. A cover support portion of which at least a portion extends backward to be supported on the door body is disposed on a lower end of the back cover.

19 Claims, 24 Drawing Sheets

(56) References Cited

U.S. PATENT DOCUMENTS

| | | | | |
|---|---|---|---|---|
| 2021/0318061 | A1* | 10/2021 | Lee | F25D 23/028 |
| 2023/0258388 | A1* | 8/2023 | Yu | F25D 29/00<br>312/405 |

FOREIGN PATENT DOCUMENTS

| | | | | |
|---|---|---|---|---|
| WO | WO-2008135431 | A1 * | 11/2008 | F25D 23/028 |
| WO | WO-2014024429 | A1 * | 2/2014 | F25D 23/02 |
| WO | WO 2016175562 | | 11/2016 | |
| WO | WO 2021172948 | | 9/2021 | |
| WO | WO-2021212934 | A1 * | 10/2021 | |

* cited by examiner

HOME APPLIANCE

CROSS-REFERENCE TO RELATED APPLICATIONS

The present application claims priority under 35 U.S.C. 119 and 35 U.S.C. 365 to Korean Patent Application Nos. 10-2021-0158031, filed on Nov. 16, 2021, and 10-2022-0013836, filed on Jan. 31, 2022, the disclosures of which are hereby incorporated by reference in their entirety.

BACKGROUND

The present disclosure relates to a home appliance.

In general, home appliances are disposed in an indoor space and may be disposed to be harmonized with the surrounding space. In addition, to further improve the appearance of the home appliance, a panel defining an outer appearance on a front surface of the home appliance may be provided.

Typically, structures that variously modify the outer appearance of the front surface of the refrigerator so as to be harmonized with environments in which the refrigerator is placed, surrounding furniture, or other home appliances are being developed, and this trend is being made throughout the home appliances.

U.S. Pat. No. 8,789,900 discloses a structure in which a decoration panel defining an outer appearance is installed on a door front of a refrigerator, and here, the outer appearance of the door front is defined according to a user's preference by detachably configuring the decoration panel.

However, the refrigerator having this structure has a problem in that, when a user wants to change the outer appearance, the entire decoration panel needs to be removed and replaced, and it is not possible to use the decoration panel before replacement any longer.

To solve this limitation, Chinese Patent Application No. 103250018 discloses a refrigerator in which a reflective layer and a transparent panel are disposed on a door front and colored light emitting members are mounted on both side ends of the reflective layer to cause the transparent panel to shine with set color.

However, in such a structure, since components constituting a door panel are added, the door panel may become heavy, and in particular, when the door panel is made of a heavy material such as glass, the door or the door panel may be sagged.

In addition, when the door is frequently opened and closed, and the repeated impact is applied, there is a more serious limitation in that the door panel is sagged or damaged by the repeated impact.

SUMMARY

Embodiments provides a home appliance in which a detachable panel assembly is firmly mounted on a door body.

Embodiments also provide a home appliance in which a panel assembly is prevented from being sagged.

Embodiments also provide a home appliance having a load supporting structure of a panel assembly using a back cover.

In one embodiment, a home appliance includes: a cabinet in which a storage space is defined; and a door configured to open and close the storage space, wherein the door includes: a door body; and a panel assembly mounted on the door body, wherein the panel assembly includes: a panel which is configured to a front surface of the door and through which light is transmitted; a lighting device configured to allow the panel to shine with a set color; and a back cover configured to define a rear surface of the panel assembly, wherein a cover support portion of which at least a portion extends backward to be supported on the door body is disposed on a lower end of the back cover.

The back cover may be made of a metal material.

The cover support portion may be provided by bending the back cover.

A lower support portion protruding forward to support a lower end of the panel assembly may be disposed on the door body, and the cover support portion may be seated on the lower support portion.

The panel assembly may further include a lower bracket configured to define a bottom surface of the panel assembly, wherein a bracket protrusion which extends backward and on which the cover support portion is seated may be disposed on the lower bracket.

A bottom surface of the cover support portion may be in contact with a top surface of the bracket protrusion.

A lower opening may be defined in a front surface of the door body, and when the panel assembly is mounted, the cover support portion may be inserted into the lower opening in the state of being seated on the bracket protrusion.

A coupling member may be provided on a bottom surface of the door body, wherein the coupling member may be coupled to pass through the bracket protrusion and the cover support portion, which are inserted into the lower opening.

The cover support portion may include a cover coupling portion that further extends backward from the cover support portion, wherein the cover coupling portion may be inserted by passing through a front surface of the door body.

The cover support portion may be continuously disposed from one end to the other end of the back cover, and the cover coupling portion may be provided in plurality to be spaced apart from each other along the cover support portion.

A coupling hole through which a coupling member coupled to a bottom surface of the door body passes may be defined in the cover coupling portion.

The panel may be disposed in front of the lower support portion, and the coupling member may be disposed behind the lower support portion so as to extend to be seated on the lower support portion protruding the bottom surface of the door body.

The cover support portion may include: a first support portion extending forward from a lower end of the back cover; and a second support portion bent backward from a front end of the first support portion to further extend backward than the first support portion.

The panel assembly may further include a lower bracket which is configured to define a bottom surface of the panel assembly and into which the lighting device is accommodated, wherein a bracket opening through which the lighting device is accessible may be defined in the lower bracket.

The back cover may be configured to shield the bracket opening.

The first support portion may be inserted into the bracket opening and extends to support the lighting device at a lower side.

The lower bracket may include a light supporter made of a metal material and configured to support the lighting device, wherein the light supporter may be exposed through the bracket opening so as to be in contact with the back cover, thereby transferring heat of the lighting device to the back cover.

The first support portion may be inserted into the bracket opening and extends to support the light supporter at a lower side.

The details of one or more embodiments are set forth in the accompanying drawings and the description below. Other features will be apparent from the description and drawings, and from the claims.

BRIEF DESCRIPTION OF THE DRAWINGS

FIG. 19 is a front view illustrating an outer appearance of the front surface of the refrigerator that is in a state in which the lighting device is turned on.

DETAILED DESCRIPTION OF THE EMBODIMENTS

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction toward a door is defined as a front direction with respect to a cabinet shown in FIGS. 2 and 2, a direction toward the cabinet with respect to the door is defined as a rear direction, a direction toward a bottom on which a refrigerator is installed is defined as a downward direction, and a direction away from the bottom is defined as an upward direction.

Figure 1:
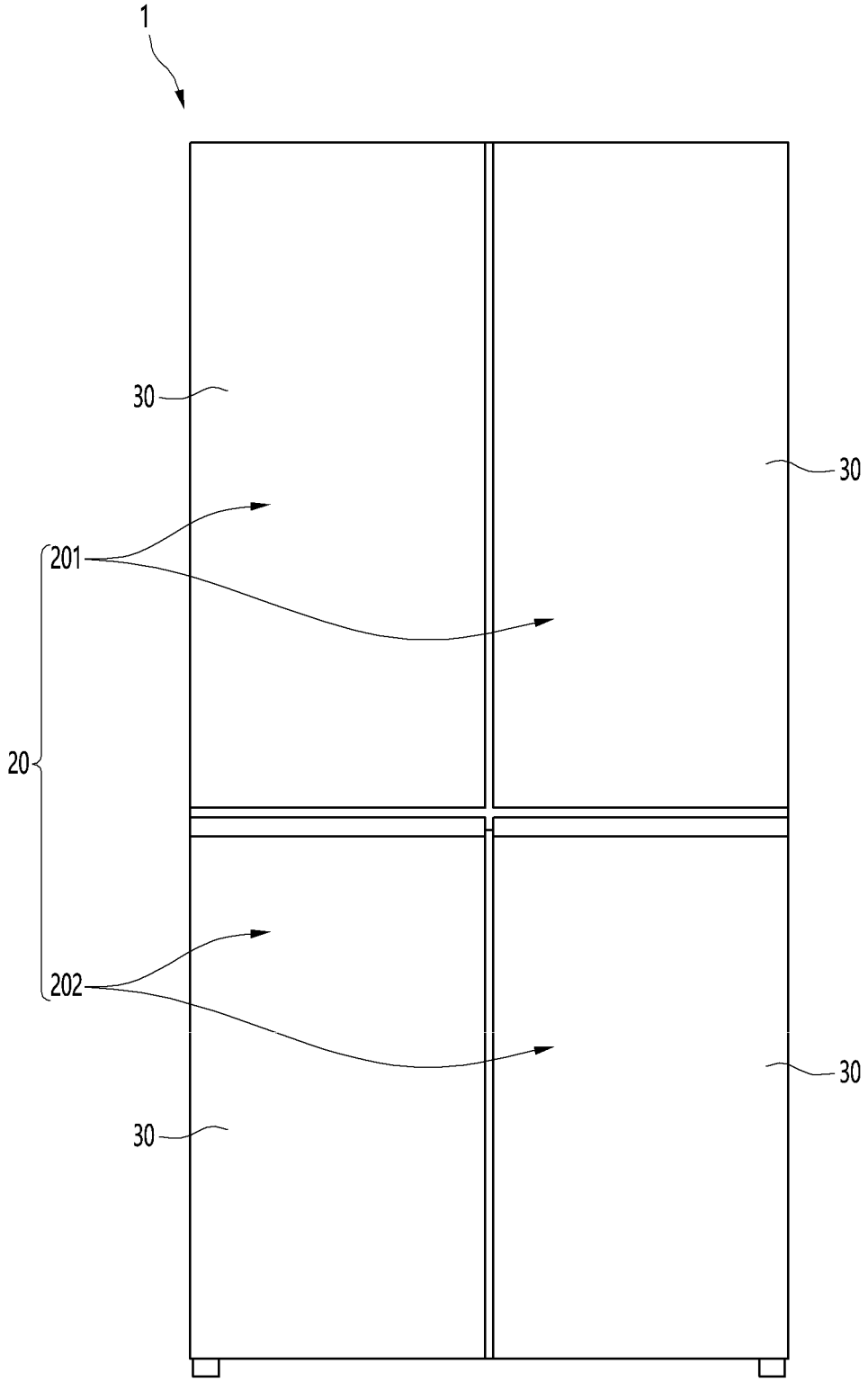
FIG. 1 is a front view of a refrigerator according to an embodiment.
Figure 2:
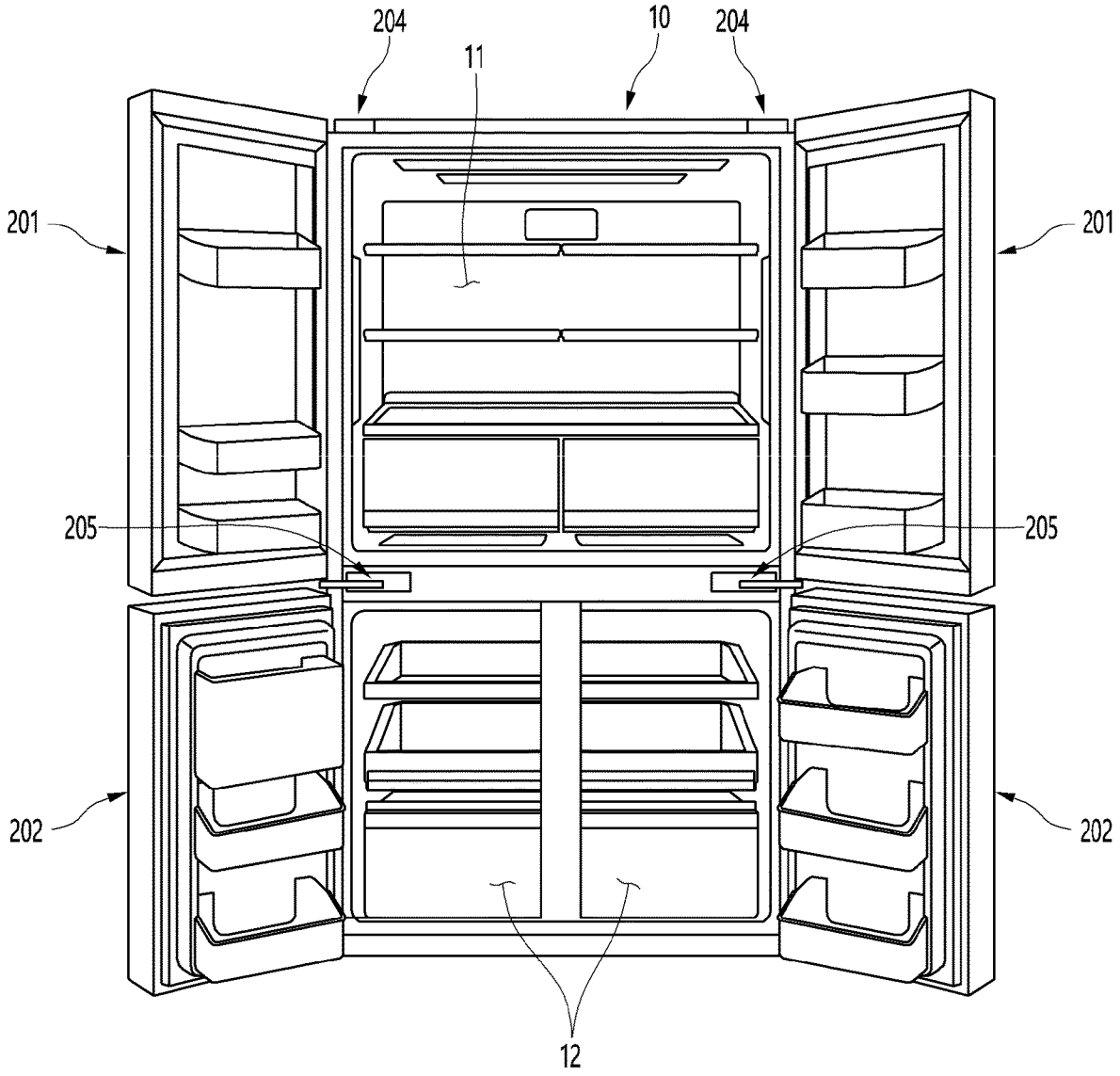
FIG. 2 is a front view illustrating a state in which a door of the refrigerator is opened.

FIG. 1 is a front view of a refrigerator according to an embodiment. Also, FIG. 2 is a front view illustrating a state in which a door of the refrigerator is opened.

As illustrated in the drawings, an outer appearance of a refrigerator 1 according to an embodiment may be defined by a cabinet 10 in which a storage space is defined, and a door 20 for opening and closing the storage space of the cabinet 10.

For example, the cabinet 10 may define the storage space partitioned in a vertical direction. Here, a refrigerating compartment 11 may be defined at an upper portion of the cabinet 10, and a freezing compartment 12 may be defined at a lower portion of the cabinet 10. The refrigerating compartment 11 may be referred to as an upper storage space, and the freezing compartment 12 may be referred to as a lower storage space.

The door 20 may be configured to open and close each of the refrigerating compartment 11 and the freezing compartment 12. For example, the door 20 may be rotatably mounted to the cabinet 10 by being connected by hinge devices 204 and 205, and each of the refrigerating compartment 11 and the freezing compartment 12 may be opened and closed by the rotation. Of course, the door 20 may also be withdrawn to open and close each of the refrigerating compartment and the freezing compartment.

The door 20 may include a refrigerating compartment door 201 that opens and closes the refrigerating compartment 11 and a freezing compartment door 202 that opens and closes the freezing compartment 12. In addition, the refrigerating compartment door 201 may be disposed in a pair side by side at both left and right sides, and each of the refrigerating compartment doors 201 may partially open and close the refrigerating compartment 11. In addition, the freezing compartment door 202 may be disposed in a pair side by side at both left and right sides, and each of the freezing compartments 12 partitioned to the left and right sides may be opened and closed.

Of course, although the refrigerator having a structure in which a refrigerating compartment 11 is disposed at an upper side, and a freezing compartment 12 is disposed at a lower side is described as an example in the embodiment, the present disclosure may be applied to all types of refrigerators equipped with a door without being limited to types of refrigerators.

An outer appearance of the front surface of the refrigerator 1 may be defined in the state in which the door 20 is closed and may define the out appearance of the refrigerator 1 viewed from the front in the state in which the refrigerator 1 is installed.

The door 20 may have a structure in which a front surface selectively emits light and may be configured to shine with set color or brightness. Thus, a user may manipulate the refrigerator 1 so that the front surface of the refrigerator 1 is changed in color or brightness of the door 20 without separating or disassembling the door 20 and may change the overall outer appearance of the refrigerator 1.

Hereinafter, the structure of the door 20 will be described in detail with reference to drawings. In addition, in an embodiment of the present disclosure will be described with reference to the refrigerator compartment door 201 disposed at the left side, and other doors may have the same structure with only a difference in mounting position.

Figure 3:
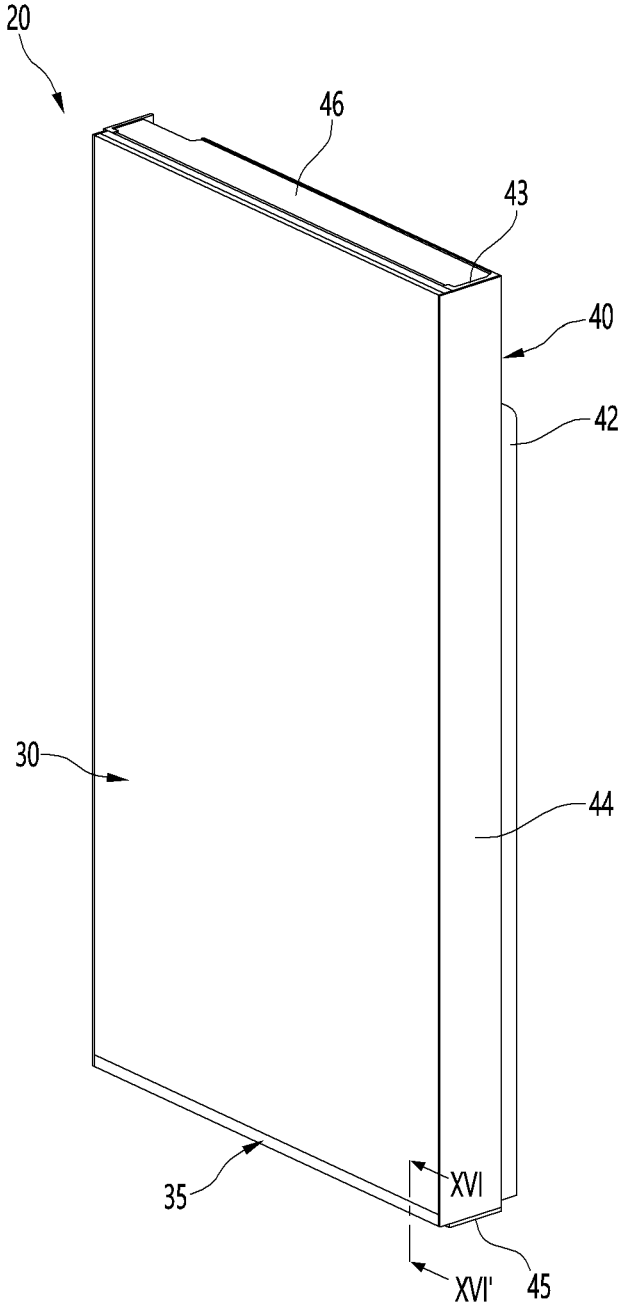
FIG. 3 is a perspective view of the door.
Figure 4:
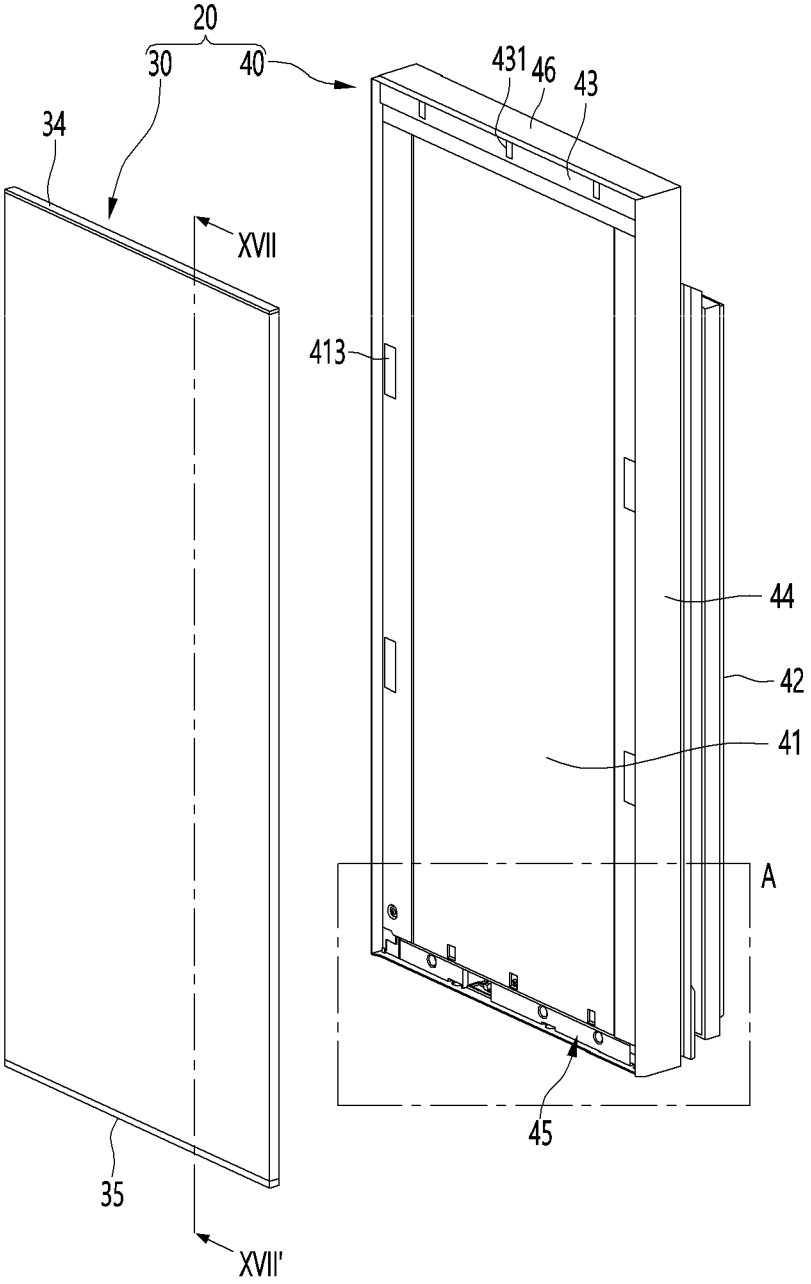
FIG. 4 is an exploded perspective view illustrating a state in a panel assembly and a door body, which are components of the door, are separated from each other.
Figure 5:
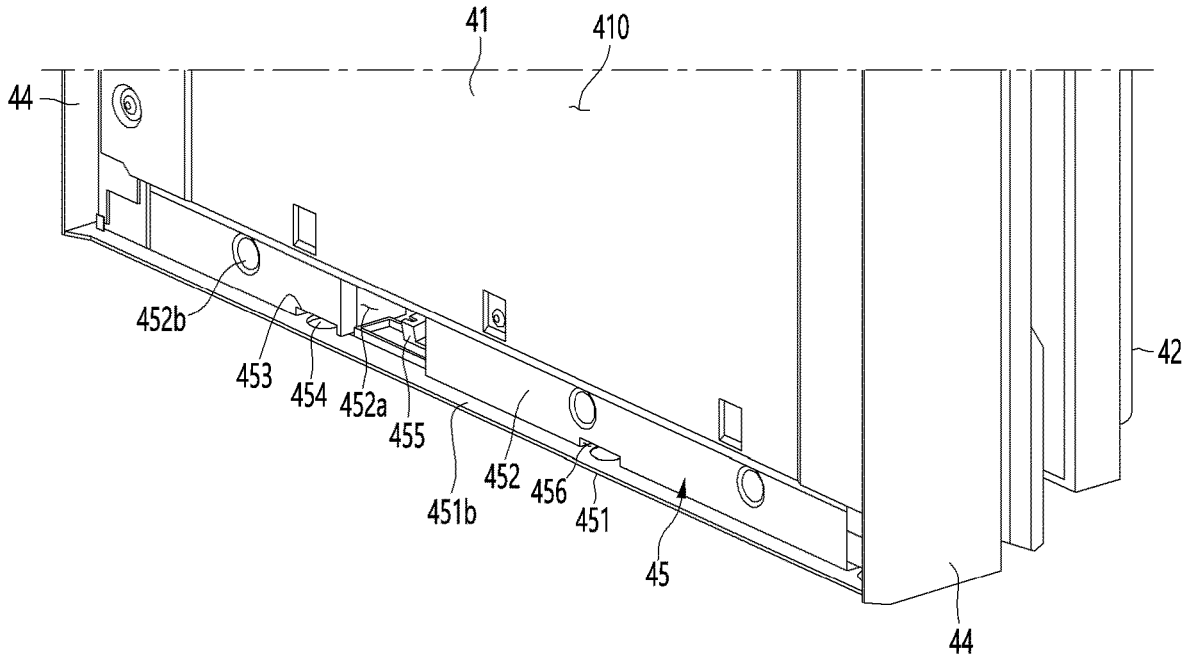
FIG. 5 is an enlarged view illustrating a portion A of FIG. 4.

FIG. 3 is a perspective view of the door. In addition, FIG. 4 is an exploded perspective view illustrating a state in which a panel assembly and a door body, which are components of the door, are separated from each other. Also, FIG. 5 is an enlarged view illustrating a portion A of FIG. 4.

As illustrated in the drawings, the door 20 may include a door body 21 defining the overall shape of the door 20 and configured to open and close the storage space and a panel assembly 30 defining an outer appearance of a front surface of the door 20. That is, the door 20 may be configured so that the panel assembly 30 is mounted on a front surface of the door body 40.

The door body 40 may include a body plate 41 defining a front surface and a door liner 42 defining a rear surface. The body plate 41 may be made of a metal material and disposed to face a rear surface of the panel assembly 30. The door liner 42 may be made of a plastic material and may form a bottom shape of the door 20.

The door body 40 may include a side decoration 44 defining right and left side surfaces of the door body 21. The side decoration 44 may connect both right and left ends of the body plate 41 and both right and left ends of the door liner 42.

The door body 40 may include an upper cap decoration 43 and a lower cap decoration 45 that form top and bottom surfaces of the door body 40. The upper cap decoration 43 may be connected to an upper end of the side decoration 44, an upper end of the body plate 41, and an upper end of the door liner 42. The lower cap decoration 45 may be connected to a lower end of the side decoration 44, a lower end of the body plate 41, and a lower end of the door liner 42.

An outer appearance of the door body 40 may be defined by the body plate 41, the door liner 42, the side decoration 44, the upper cap decoration 43, and the lower cap decoration 45. In addition, an insulator (reference numeral 400 in FIG. 16) may be filled in an internal space of the door body 40, which is defined by coupling the body plate 41, the door liner 42, the side decoration 44, the upper cap decoration 43, and the lower cap decoration 45.

The panel assembly 30 may be inserted into and mounted on the front surface of the door body 40. For example, the side decoration 44 and the lower cap decoration 45 may further protrude forward and may be in contact with both ends and a lower end of the panel assembly 30. Thus, a space 410 in which the panel assembly 30 may be accommodated may be defined in the door body 40 by the side decoration 44 and the lower cap decoration 45. In addition, the top surface of the panel assembly 30 may define the same plane as the upper cap decoration 43, thereby defining the top surface of the door 20.

The panel assembly 30 may be provided in a plate shape and may define an outer appearance of the front surface of the door 20 while being mounted on the front surface of the door body 40. Since the panel assembly 30 may form the outer appearance of the front surface of the door 20, the panel assembly 30 may be referred to as a door panel, and since the panel assembly 30 may form the outer appearance of the front surface of the refrigerator 1, the panel assembly 30 may also be referred to as an exterior panel.

The panel assembly 30 may be detachably mounted on the door body 40. The lower end of the panel assembly 30 may be supported by the lower cap decoration 45, and an upper protrusion 343 may be disposed on an upper end of the rear surface of the panel assembly 30 and be inserted and mounted into an upper mounting portion 431 on the front surface of the door body 40. In addition, the upper protrusion 343 may be restricted by an upper cover 46 mounted on an opened top surface of the upper cap decoration 43.

The lower cap decoration 45 may include a lower cap decoration bottom surface 451 defining a bottom surface and a lower cap decoration front surface 452 extending upward from the lower cap decoration bottom surface 451 to define a front surface. In addition, a lower support portion 451*b* protruding more than the lower cap decoration front surface 452 may be disposed on the front end of the lower cap decoration bottom surface 451. The lower support portion 451*b* may extend to overlap at least a portion of the bottom surface of the panel assembly 30 and may support the lower end of the panel assembly 30 from a lower side.

In addition, a lower opening 453 may be defined in the lower cap decoration front surface 452. The lower opening 453 may be defined at a position corresponding to the coupling portions 357 and 396*c* so that the coupling portions 357 and 396*c* protruding backward from the rear end of the rear surface of the panel assembly 30 are inserted. A lower end of the lower opening 453 may be in contact with a top surface of the lower support portion 451*b*, and an insertion portion (reference numeral 456 in FIG. 16) into which the coupling portions 357 and 396*c* are inserted and accommodated may be defined in a lower end of the lower opening 453. In addition, a screw hole 454 into which a coupling member (reference numeral 457 in FIG. 16) for restricting the lower end of the panel assembly 30 to the door body 40 is inserted may be opened on an inner bottom surface of the lower opening 453.

A plurality of lower openings 453 may be spaced apart from each other along the lower support portion 451*b* and may be disposed to lean to a different one end that is away from one end on which the hinge device 205 for rotation among both left and right ends of the door body 40 is mounted.

In addition, a recessed groove 452*b* may be formed on the front surface 452 of the lower cap decoration 45 so as not to interfere with the exposed portion of the screw 397*b* coupled to the back cover 39. The grooves 452*b* may be defined in a number corresponding to positions corresponding to the screws 397*b*.

In addition, a connector hole 452*a* through which a wire connected to a lighting device (reference numeral 36 in FIG. 11) provided in the panel assembly 30 passes may be defined in the lower cap decoration front surface 452. In addition, a connector 455 connected to the electric wire may be disposed inside the connector hole 452*a*. A connector corresponding to the connector 455 may be detachably provided on an end of the electric wire and may be configured to facilitate the connection and separation of the electric wire when the panel assembly 30 is detached.

As described above, the panel assembly 30 may be detachably mounted from the door body 40 for services and maintenance.

A front surface of the panel assembly 30 may be exposed forward in the state in which the panel assembly 30 is mounted on the door body 40, and the panel assembly 30 may substantially form the outer appearance of the front surface of the door 20. That is, a color of the outer appearance of the front surface of the door 20 may be determined by a color of the front surface of the panel assembly 30. In addition, the entire front surface of the panel assembly 30 may be configured to shine in a color specified by the user, and in the state in which the door 20 and the panel assembly 30 are mounted, various colors selected by the user may be changed by the operation of the lighting device 36 to variously express the color of the front surface of the door 20.

Hereinafter, the structure of the panel assembly 30 will be described in more detail with reference to drawings.

Figure 6:
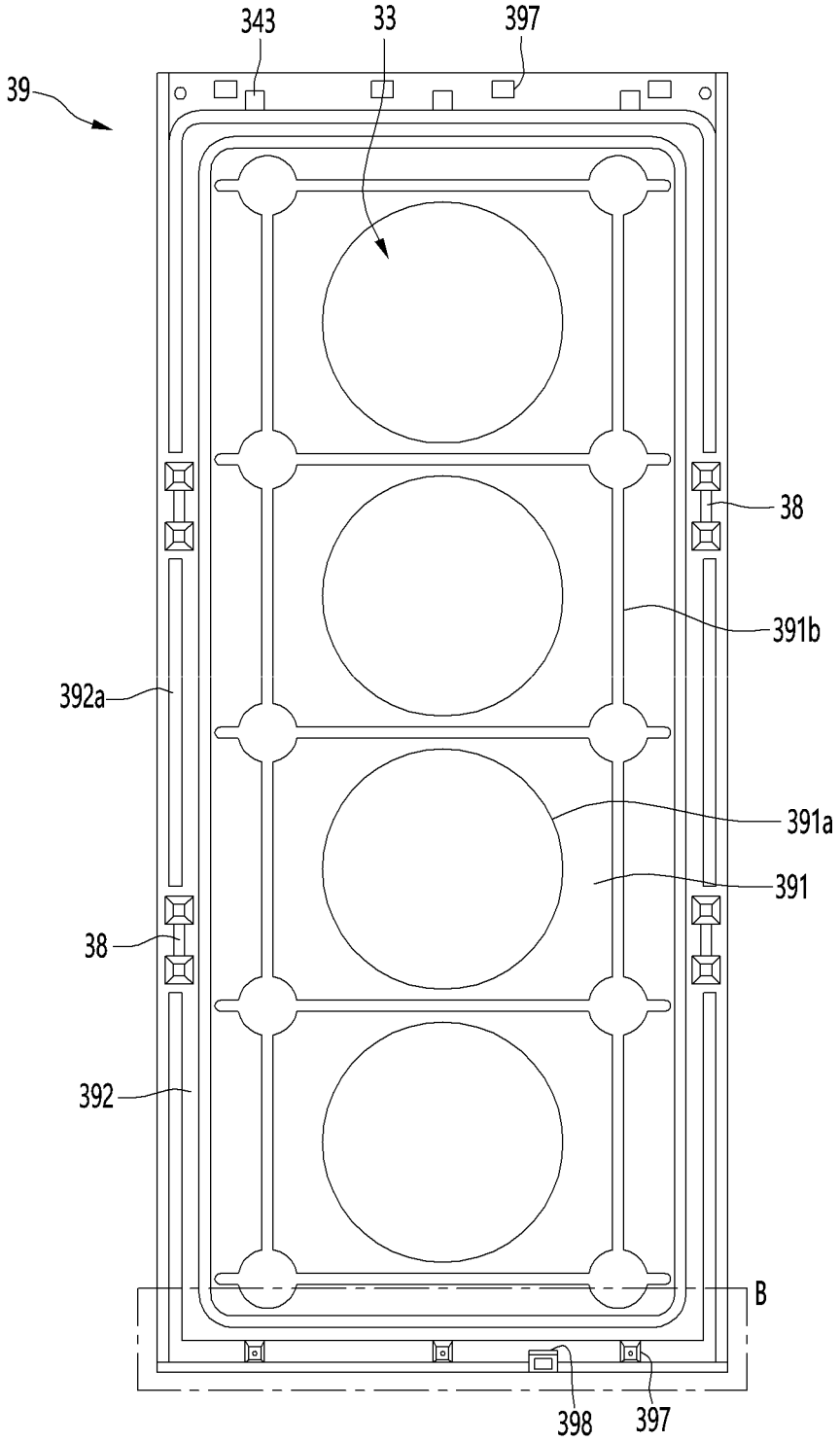
FIG. 6 is a rear view of the panel assembly.
Figure 7:
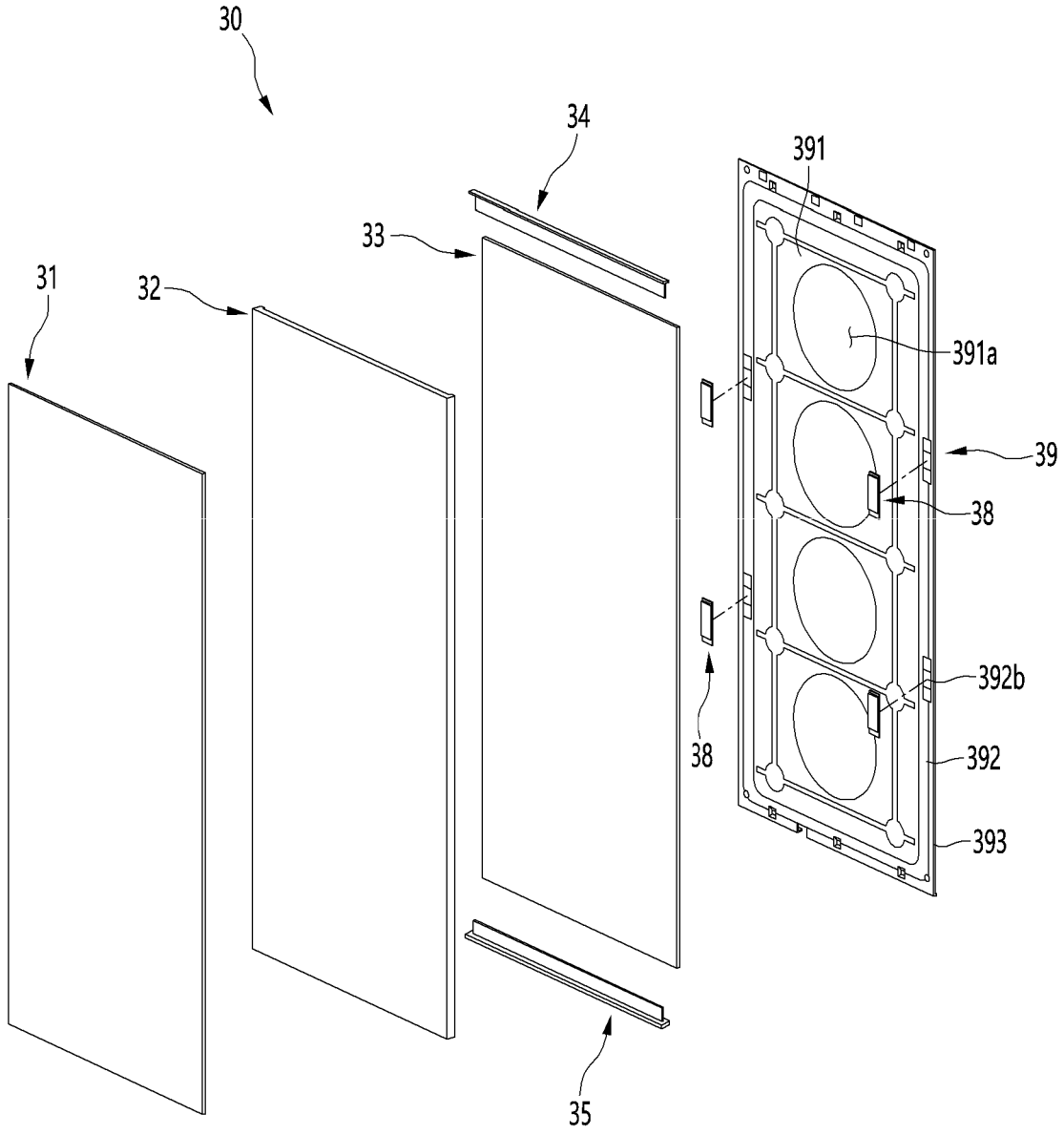
FIG. 7 is an exploded front perspective view illustrating the panel assembly.
Figure 8:
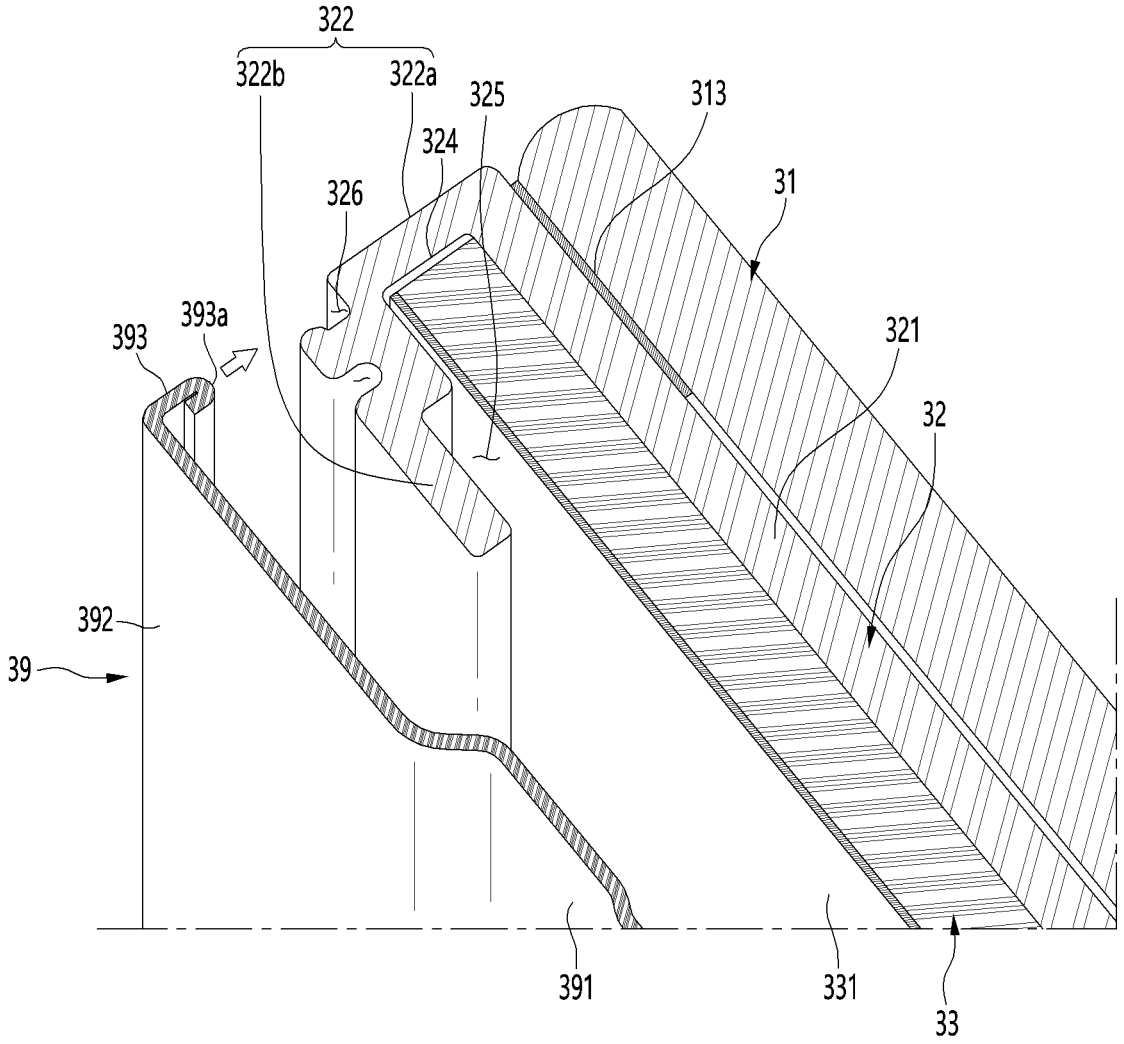
FIG. 8 is a cutaway perspective view illustrating a coupling structure of a fixing member and a side end of a back cover.

FIG. 6 is a rear view of the panel assembly. In addition, FIG. 7 is an exploded front perspective view illustrating the panel assembly. FIG. 8 is a cutaway perspective view illustrating a coupling structure of a fixing member and a side end of a back cover.

As illustrated in the drawing, the panel assembly 30 may include a panel 31 defining an outer appearance of a front surface thereof, a lighting device 36 emitting light so that the panel 31 shines, and a back cover 39 defining an outer appearance of a rear surface of the panel assembly 30. In addition, the panel assembly 30 may further include a light guide plate 33 that guides the light irradiated from the lighting device.

In addition, the panel assembly 30 may further include a fixing member 32 that mounts the light guide plate 33 and the panel 31.

The panel assembly 30 may include an upper bracket 34 forming a top surface of the panel assembly 30 and a lower bracket 35 forming a bottom surface of the panel assembly 30. The lighting device 36 may be mounted on the lower bracket 35.

In more detail, the panel 31 may be provided in a rectangular plate shape and may be made of a transparent material that transmits light therethrough. For example the panel 31 may be made of a glass material such as blue glass, white glass, and vapor deposition glass or may be made of other materials for transmitting light therethrough, such as ABS, PMMA, or PC. In all embodiments of the present disclosure, the terms "transparent" and "transmission" may be defined as a state in which the light passes to display a set color through the panel 31.

In addition, the panel 31 may be provided to have a color. The panel 31 (front plate) may be configured to transmit light emitted from the lighting device 36 but components behind the front plate 31 may not be seen therethrough.

In addition, the panel 31 may be mounted on a front surface of the fixing member 32. In the state in which the panel 31 is attached to the fixing member 32, when viewed from the front, the components disposed behind the panel 31 in addition to the fixing member 32 may not be exposed to the outside, and the outer appearance of the front surfaces of the panel assembly 30 and the door 20 may be defined.

The light guide plate 33 may be positioned at a rear spaced apart from the panel 31 and may be configured to guide light emitted from the lighting device 36 disposed below the light guide plate 33 forward toward the panel 31. A reflective layer 331 may be disposed on a rear surface of the light guide plate 33 so that light inside the light guide plate 33 is directed forward.

The fixing member 32 may be disposed between the panel 31 and the light guide plate 33. The fixing member 32 may be configured so that the light guide plate 33 and the panel 31 are fixedly mounted thereon. The fixing member 32 may be made of a material that allows light to pass therethrough.

The fixing member 32 may include a front surface portion 321 having a plate shape, and a side surface portion 322 that protrudes backward from each of both right and left ends of the front surface portion 321. The front surface portion 321 may be disposed between the panel 31 and the light guide plate 33, and also, the front surface may be in contact with the panel 31, and the rear surface may be in contact with the light guide plate 33, In addition, the side surface portion 322 may provide a structure on which the light guide plate 33 is fixed, and the upper bracket 34, the lower bracket 35, and the back cover 39 are mounted.

In detail, the front surface portion 321 may be provided in the plate shape having a size corresponding to that of the panel 31, and an adhesive member 313 may be applied around the front surface portion 321 so that the panel 31 adheres to the fixing member 32.

The side surface portion 322 may be disposed along both the left and right ends of the light guide plate 33. In addition, the upper bracket 34, the lower bracket 35, and the back cover 39 may also be mounted on the side surface portion 322. In detail, the side surface portion 322 may include a first part 322*a* extending backward from each of both left and right ends of the front surface portion 321 and a second part 323 bent from an end of the first part 322*a*. The first part 322*a* may extend perpendicular to the front surface portion 321 from each of both the left and right ends of the front surface portion 321 and may define a side surface of the panel assembly 30.

In addition, a restriction groove 326 may be defined in the first part 322*a*. The restriction groove 326 may be defined so that the side restriction portion 393*a* of the back cover 39 is inserted when the back cover 39 is mounted. The second part 322*b* may extend perpendicular to the first part 322*a*. The second part 322*b* may be configured to restrict the light guide plate 33 and simultaneously restrict both the ends of the upper bracket 34 and the lower bracket 35.

In detail, the front surface of the second part 322*b* may be defined to have a stepped shape. Thus, a light guide plate insertion space 324 and a bracket insertion space 325 may be defined in the side surface portion 322 by the first part 322*a*, the second part 322*b*, and the front surface portion 321, respectively.

In a state in which the light guide plate 33 is inserted into the light guide plate insertion space 324, both left and right ends of the light guide plate 33 may be restricted, and movement of the light guide plate 33 in the front and rear direction may be restricted. In addition, the lower end of the light guide plate 33 may be disposed to face the lighting device 36.

The upper bracket 34 and the lower bracket 35 may be inserted into the bracket insertion space 325 to be firmly coupled to the fixing member 32. In addition, the upper bracket 34 and the lower bracket 35 may define top and bottom surfaces of the panel assembly 30 in a state of being coupled to the fixing member 32 and may be coupled to the back cover 39.

The lighting device 36 may be mounted on the lower bracket 35. The lighting device 36 may be provided inside the lower bracket 35 to irradiate light toward the light guide plate 33 and may be assembled and mounted with the lower bracket 35 in the state of being mounted on the lower bracket 35.

The structures of the upper bracket 34, the lower bracket 35, and the back cover 39 will be described in more detail below.

Figure 9:
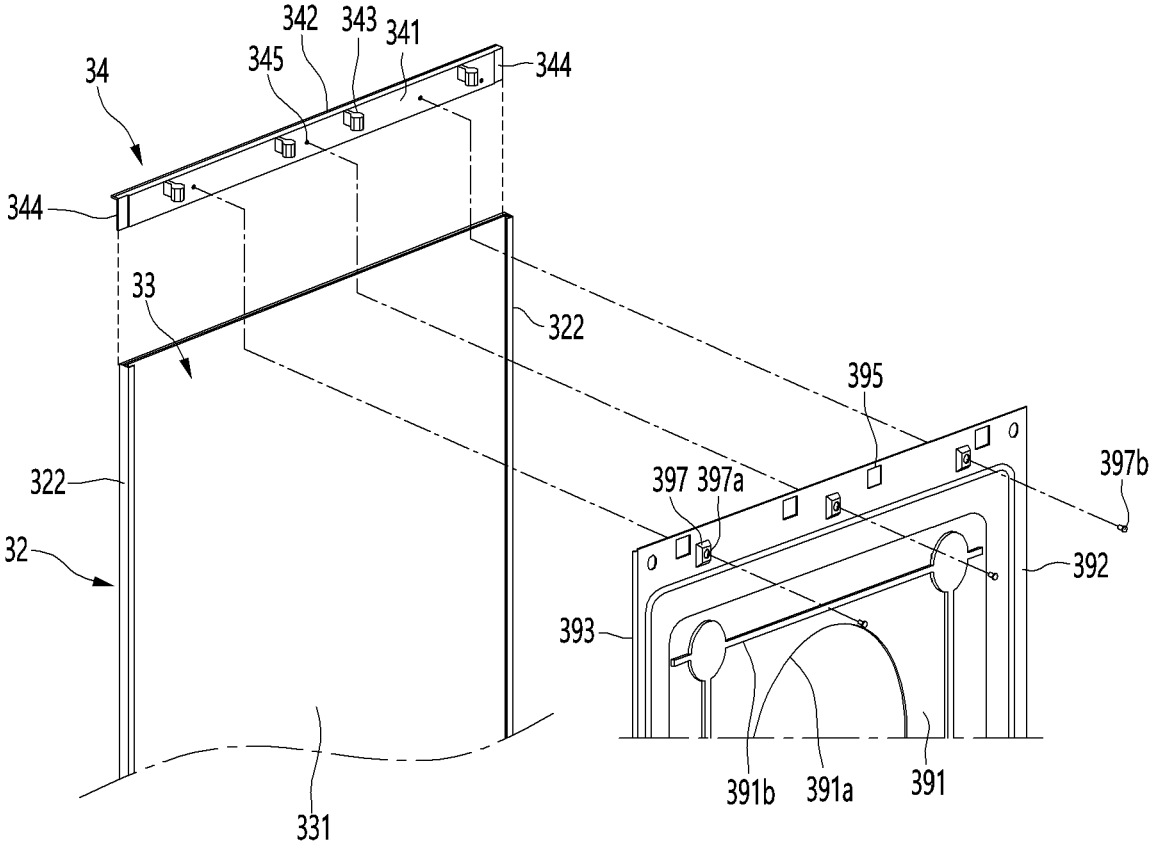
FIG. 9 is an exploded perspective view illustrating a coupling structure of the fixing member, the lower bracket, and the back cover, which are components of the panel assembly.

FIG. 9 is an exploded perspective view illustrating a coupling structure of the fixing member, the lower bracket, and the back cover, which are components of the panel assembly.

As illustrated in the drawings, the upper bracket 34 may include an upper bracket extension portion 341 and an upper bracket top surface portion 342. The upper bracket extension portion 341 may be configured to the upper bracket 34 may be disposed in parallel with the panel 31 and the light guide plate 33 to extend in the vertical direction.

In addition, an upper bracket mounting portion 344 may be disposed on each of both left and right ends of the upper bracket extension portion 341. The upper bracket mounting portion 344 may be inserted by being slid downward from an upper side of the bracket insertion space 325.

In the state in which the upper bracket 34 is mounted on the fixing member 32, the upper bracket mounting portion 344 may be fixed in the bracket insertion space 325, and the remaining upper bracket extension portion 341 may be exposed between both the side surface portions 322 to support the upper end of the back cover 39 and to be coupled to the upper end of the back cover 39.

An upper protrusion 343 protruding backward may be disposed on a rear surface of the upper bracket extension portion 341. The upper protrusion 343 may protrude from the upper bracket extension portion and be coupled to the upper mounting portion 431 of the upper cap decoration 43.

In addition, a plurality of the upper protrusions 343 may be provided at regular intervals along the upper bracket 34. In addition, the upper protrusion 343 may protrude to pass through the protrusion opening 395 of the back cover 39 when the back cover 39 is mounted.

An upper bracket screw hole 345 to be coupled to the screw 397*b* may be defined in the upper bracket extension portion 341. When the back cover 39 is mounted, the screw 397*b* may be coupled to sequentially pass through the cover screw hole 397*a* defined in the back cover 39 and the upper bracket screw hole 345.

The upper bracket top surface portion 342 may be disposed on an upper end of the upper bracket extension portion 341. The front end of the upper bracket top surface portion 342 may support the upper end of the panel 31 and completely shield the upper ends of the fixing member 32 and the light guide plate 33.

Figure 10:
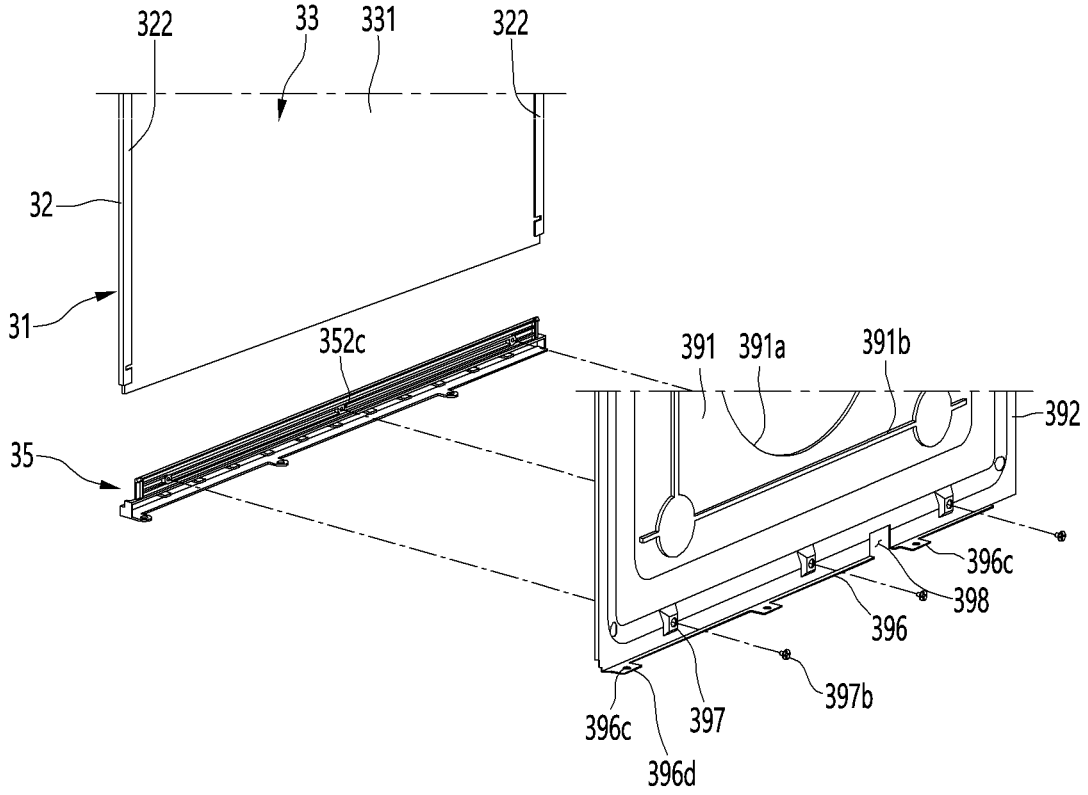
FIG. 10 is an exploded perspective view illustrating a coupling structure of the fixing member, the lower bracket, and the back cover, which are components of the panel assembly.
Figure 11:
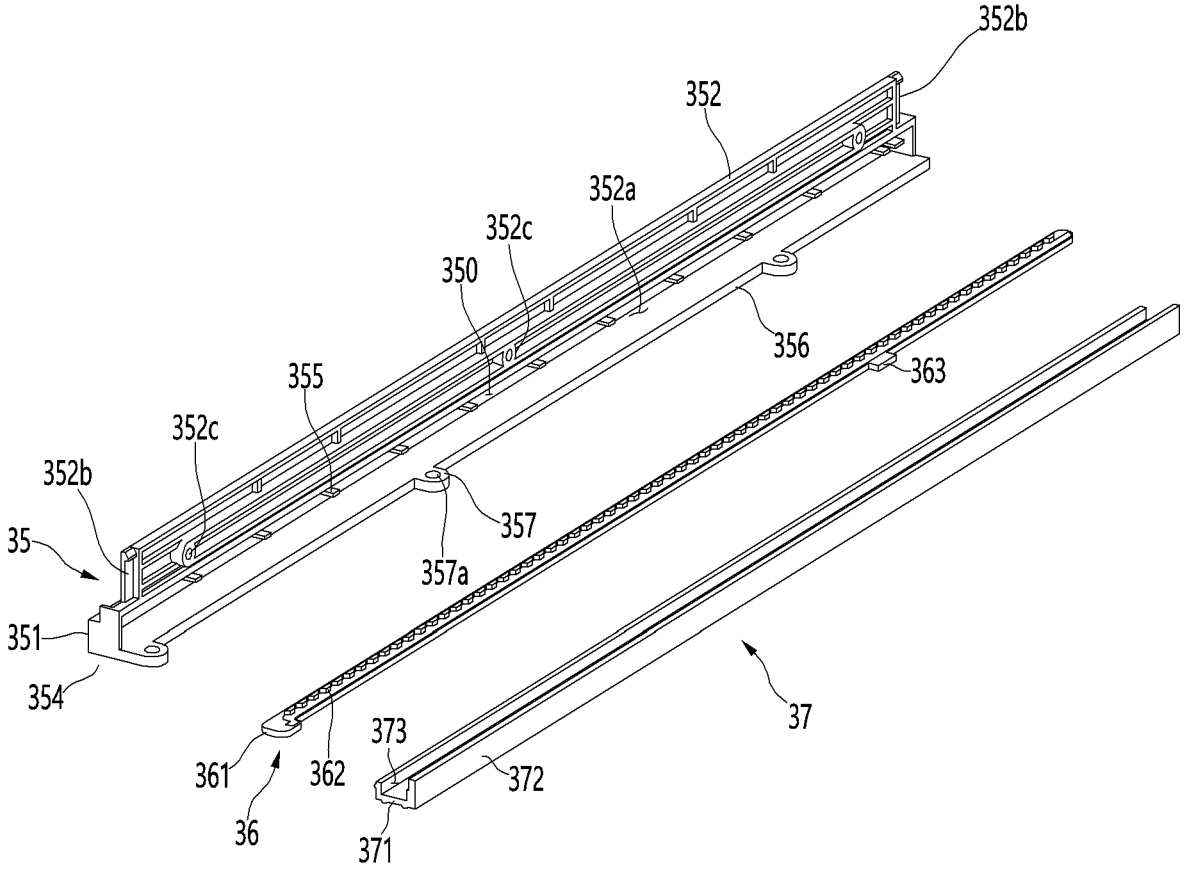
FIG. 11 is an exploded perspective view illustrating a coupling structure of the lower bracket, a lighting device, and a light supporter.

FIG. 10 is an exploded perspective view illustrating a coupling structure of the fixing member, the lower bracket, and the back cover, which are components of the panel assembly. Also, FIG. 11 is an exploded perspective view illustrating a coupling structure of the lower bracket and a lighting device.

As illustrated in the drawings, the lower bracket 35 may include a lower bracket front surface portion 351, a lower bracket rear surface portion 352, a lower bracket side surface portion 353, and a lower bracket bottom surface portion 354.

The lower bracket front surface portion 351 may define a shape of the front surface of the lower bracket 35, and an upper end (reference numeral 351*a* in FIG. 14) of the lower bracket front surface portion 351 may support a lower end of the panel 31. The panel support portion 351*a* may protrude upward more than the upper end of the light source 362 of the lighting device 36.

The lower bracket rear surface portion 352 may be disposed at a position spaced backward from the lower bracket front surface portion 351. The lower bracket rear surface portion 352 may define a rear surface of the lower bracket 35 and may protrude more upward than the lower bracket front surface portion 351 and the lower bracket side surface portion 353 to support the light guide plate 33 at the rear side and then may be coupled to the back cover 39.

A lower bracket mounting portion 352*b* that is disposed to be stepped forward may be disposed on each of both left and right ends of the lower bracket rear surface portion 352. The lower bracket mounting portion 352*b* may be inserted from a lower side of the bracket insertion space 325.

A lower bracket screw hole 352*c* to which a plurality of screws 397*b* are coupled may be defined in the lower bracket rear surface portion 352. When the back cover 39 is mounted, the screw 399 may be coupled to sequentially pass through the cover screw hole 397*a* and the lower bracket screw hole 352*c*.

A bracket opening may be defined in the lower bracket rear surface portion 352. The lighting device 36 may be accessible through the bracket opening 352*a*. The bracket opening 352*a* may be shielded by the back cover 39.

The lower bracket bottom surface portion 354 may define a bottom surface of the lower bracket 35 and may define a bottom surface of the space in which the lighting device 36 is mounted. In addition, the bracket support portion 356 protruding backward may be disposed on a rear end of the lower bracket bottom surface portion 354. The bracket support portion 356 may protrude more backward than the lower bracket rear surface portion 352 and may be supported by a lower end of the lower cap decoration 45 when the panel assembly 30 is mounted.

In addition, the bracket support portion 356 may further include a bracket coupling portion 357. The bracket coupling portion 357 protruding further backward may be disposed on the bracket support portion 356. The bracket support portion 356 may be continuously disposed from one end to the other end of the lower bracket 35, and the bracket coupling portion 357 may be provided in plurality to be spaced apart along the bracket support portion 356. The bracket coupling portion 357 may be inserted into the lower opening 453 so that the panel assembly 30 is firmly coupled to the door body 40. In addition, a bracket coupling hole 357*a* through which the coupling member 457 passes may be defined in the bracket coupling portion 357.

In addition, the bracket support portion 356 and the bracket coupling portion 357 may protrude in shapes corresponding to the cover support portion 396 and the cover coupling portion 396*c*, which are disposed on the lower end of the back cover 39, to support the cover support portion 396 and the cover coupling portion 396*c* at the lower side. The bracket support portion 356 and the bracket coupling portion 357 may be integrally provided and may protrude more backward than the bracket rear surface portion 352 and thus may be referred to as the bracket protrusion. In this case, the bracket protrusion may be formed to have a size and shape corresponding to the cover support portion 396 and the cover coupling portion 396*c*, i.e., the bending portion to overlap each other.

The light guide plate support portion 355 supporting the lower end of the light guide plate 33 may be provided in plurality on the lower bracket 35. The lower end of the light guide plate 33 may be supported by the light guide plate support portion 355 to maintain a distance from the lighting device 36.

The lighting device 36 may be provided within the lower bracket 35. The lighting device 36 may include a substrate 361 and a light source 362. The substrate 361 may be accommodated in the lower bracket 35, and a plurality of light sources 362 may be continuously disposed at regular intervals on the substrate 361.

The light source 362 may be disposed to emit light toward the lower end of the light guide plate 33. An example of the light source 362 may include an light-emitting diode (LED). In addition, the light source 362 may include an RGB LED that emits light with various colors under a control of a controller. That is, the light source 362 may emit light of various colors according to a user's manipulation, and thus the panel 31 may shine in a color set by the user. In addition, a color of an outer appearance of the front surface of the refrigerator 1 may be determined according to the color of the panel 31.

A substrate connection portion 363 protruding backward may be disposed at one side of the substrate 361, and an electric wire may be connected to the substrate connection portion 363. The substrate connection portion 363 may protrude to be exposed through a wire entrance 398 defined in the back cover 39, and the wire may enter and exit through the wire entrance 398.

A light supporter 37 may be provided under the substrate 361. The light supporter 37 may include a horizontal portion 371 and a vertical portion 372. The horizontal portion 371 may define a bottom surface of the light supporter 37 and may be disposed below the substrate 361 to support the substrate 361. In this case, a supporting groove 373 that prevents an interference with elements of the substrate 361 may be defined in the horizontal portion 371.

A rear end of the horizontal portion 371 may extend to the bracket opening 352*a*, and the vertical portion 372 may extend upward from the rear end of the horizontal portion 371. The vertical portion 372 may support a rear end of the substrate 361 from the rear side. In addition, the vertical portion 372 may be exposed through the bracket opening 352*a* and may shield at least a portion of the bracket opening 352*a*.

When the back cover 39 is mounted on the lower bracket 35, the vertical portion 372 exposed through the bracket opening 352*a* may be in contact with the front surface of the back cover 39. Thus, heat from the substrate 361 may be transferred to the back cover 39 through the light supporter 37 and may be radiated through the entire rear surface of the panel assembly 30.

Hereinafter, the structure of the back cover 39 will be described in more detail with reference to the drawings.

Figure 12:
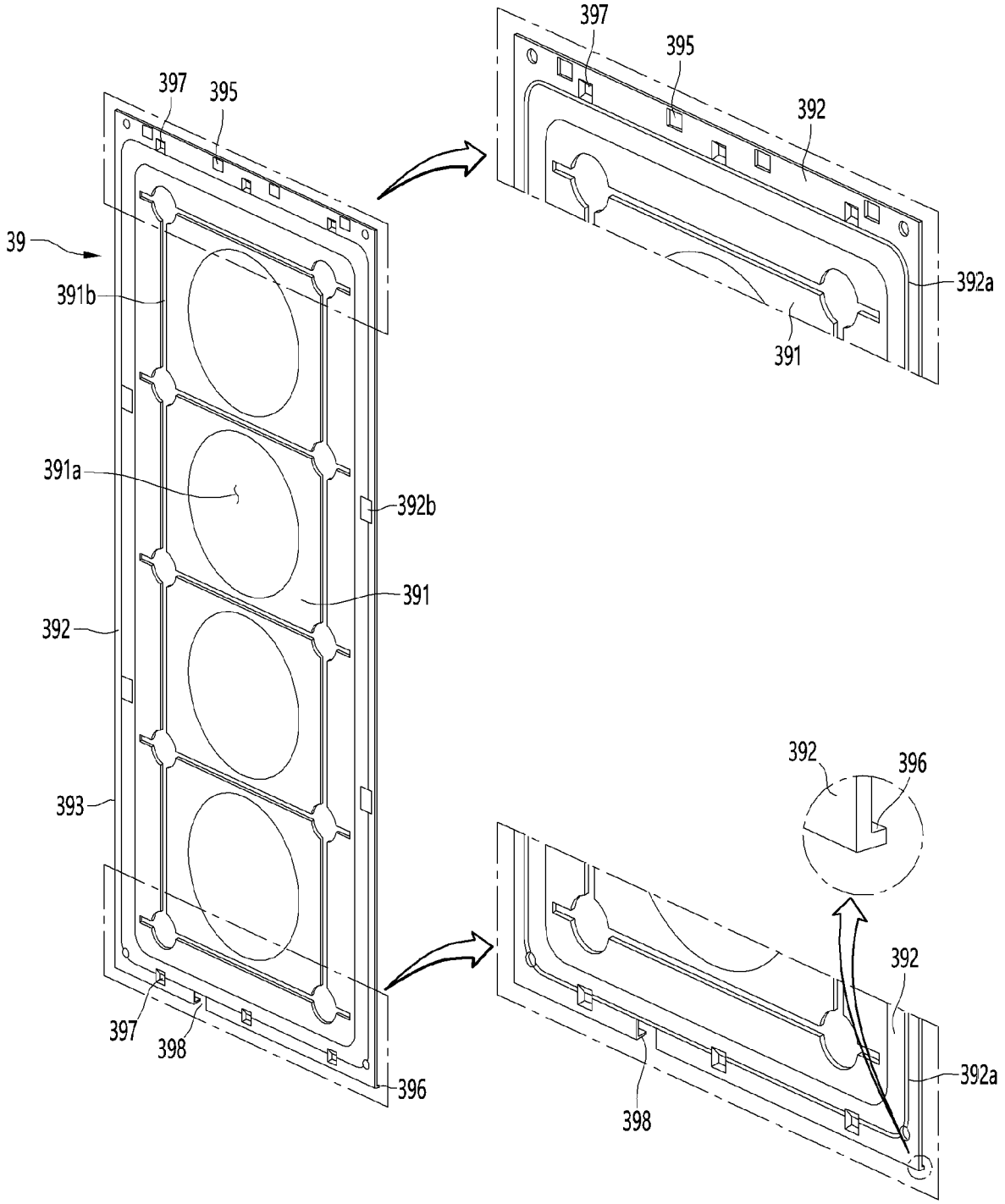
FIG. 12 is a front perspective view of the back cover.
Figure 13:
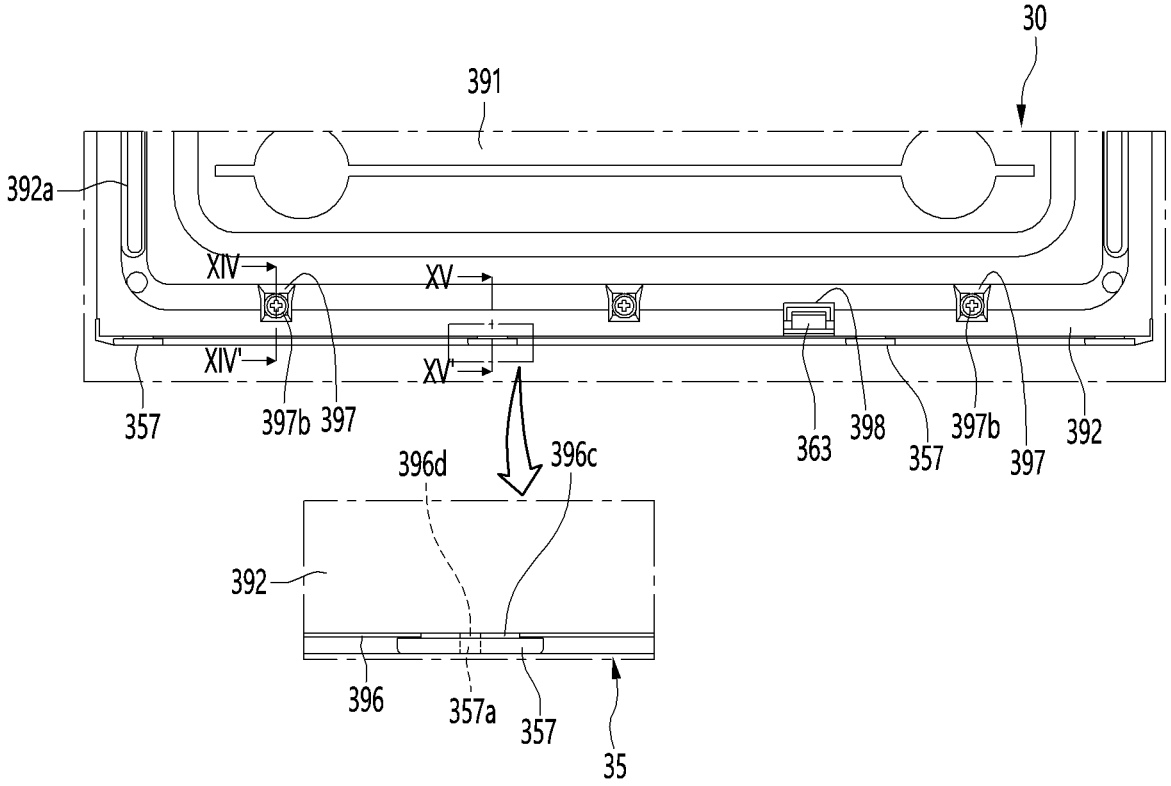
FIG. 13 is an enlarged view illustrating a portion B of FIG. 6.
Figure 14:
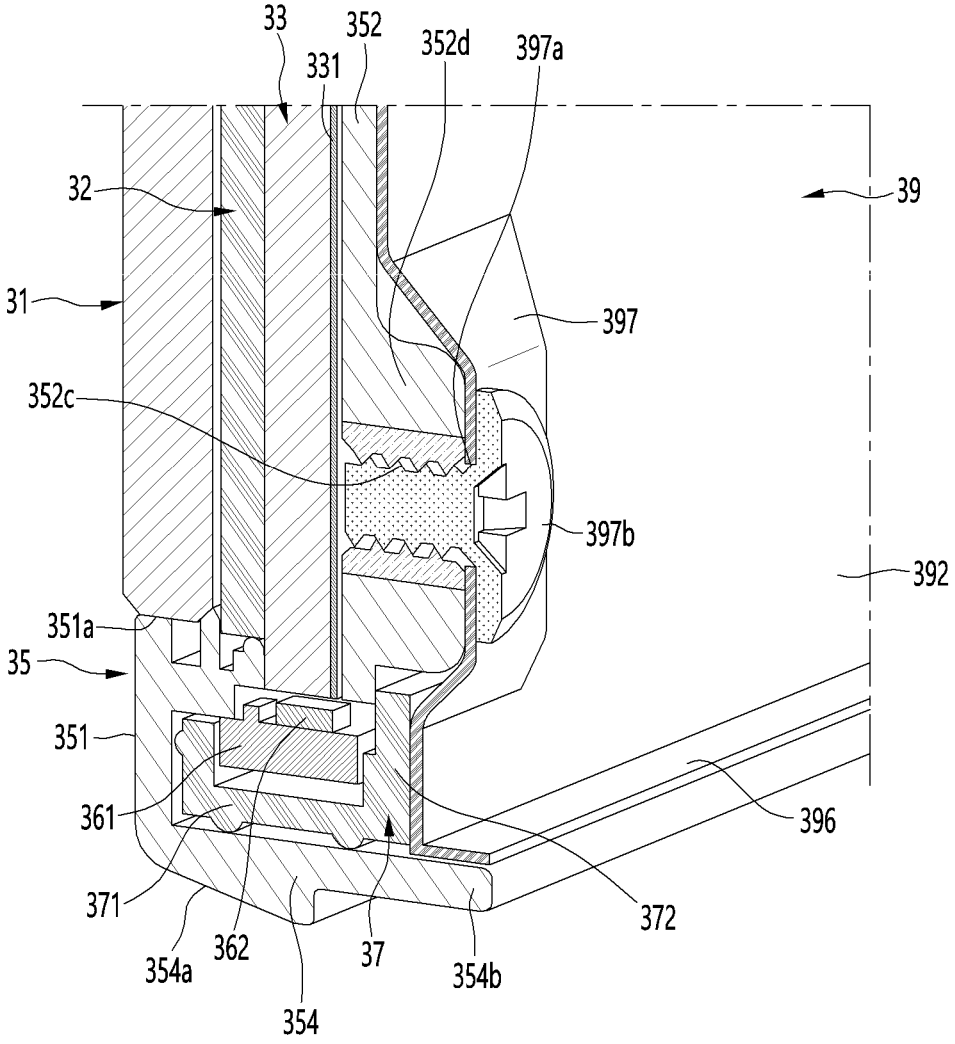
FIG. 14 is a cutaway perspective view taken along line XIV-XIV' of FIG. 13.
Figure 15:
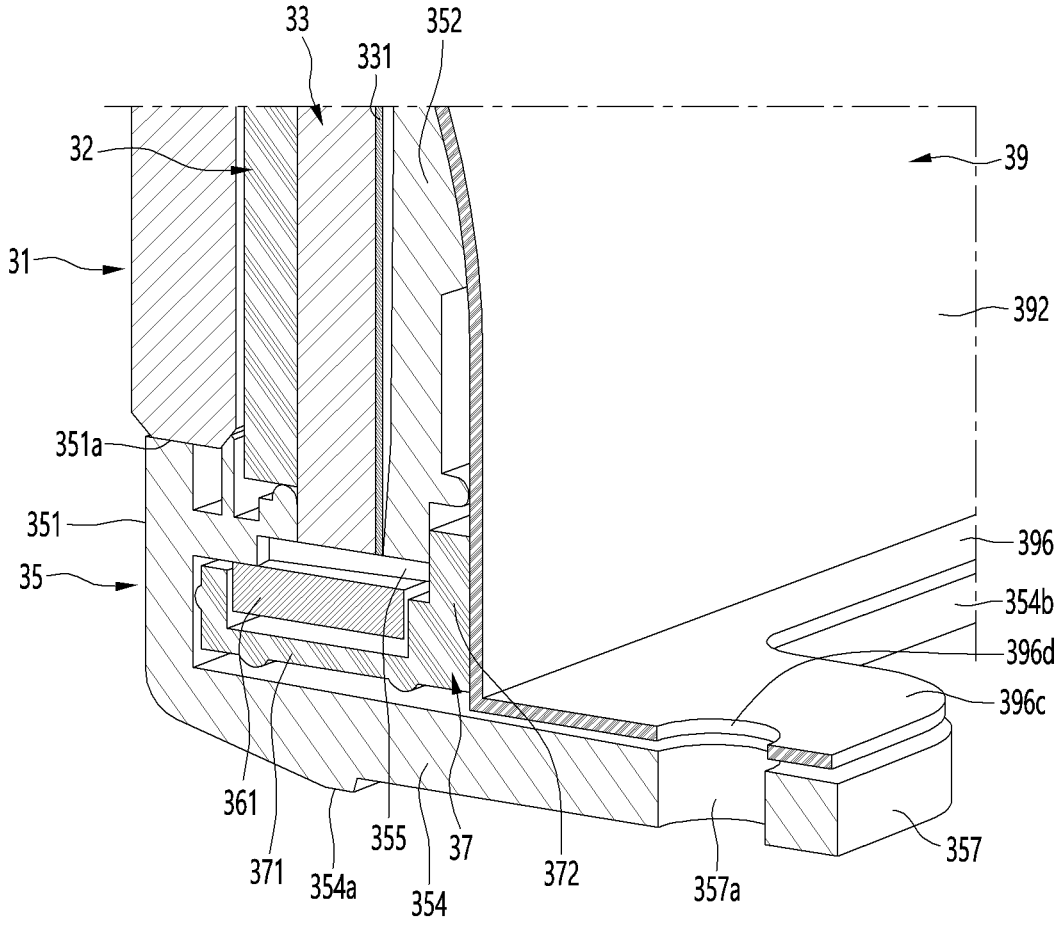
FIG. 15 is a cutaway perspective view taken along line XV-XV' of FIG. 13.

FIG. 12 is a front perspective view of the back cover. Also, FIG. 13 is an enlarged view illustrating a portion B of FIG. 6. Also, FIG. 14 is a cutaway perspective view taken along line XIV-XIV' of FIG. 13. FIG. 15 is a cutaway perspective view taken along line XV-XV' of FIG. 13.

As illustrated in the drawings, the back cover 39 may be provided in the form of a plate made of a metal material and may define the rear surface of the panel assembly 30. The back cover 39 may include a cover protrusion 391 at the center of the back cover 39 and a cover circumferential portion 392 disposed along a circumference of the cover protrusion 391, and the cover protrusion 391 and the cover circumferential portion 392 may be provided through forming.

The cover protrusion 391 may be disposed inside the cover circumferential portion 392, that is, at the center of the back cover 39 and may protrude more forward than the cover circumferential portion 392. In addition, when the back cover 39 is mounted, the rear surface of the light guide plate 33 may be supported by the cover protrusion 391. The cover protrusion 391 may support most of an area including the center of the light guide plate 33 from the rear side. Thus, although the light guide plate 33 having both supported ends may have a large plate-like structure, the light guide plate 33 may be more stably supported by the cover protrusion 391.

In addition, a plurality of cover holes 391*a* may be defined inside the cover protrusion 391. The cover hole 391*a* may be defined in a center based on the left and right direction of the cover protrusion 391, and the plurality of cover holes 391*a* may be continuously defined in the vertical direction. An overall weight of the back cover 39 may be reduced by the cover hole 391*a*, and only a portion of the cover protrusion 391 may be opened so that the remaining cover protrusion 391 supports the light guide plate 33. The cover hole 391*a* may be provided in a circular shape and may prevent the back cover 39 from being deformed by dispersing an impact or load applied to the back cover 39.

A plurality of protrusion reinforcing portions 391*b* may be disposed inside the cover protrusion 391. The plurality of the protrusion reinforcing portions 391*b* may be provided in a horizontal direction and a longitudinal direction of the cover protrusion 391 and be disposed to pass between the plurality of cover holes 391*a* to additionally reinforce the cover protrusion 391.

The cover circumferential portion 392 may define the circumference of the back cover 39 and may be disposed along the circumference of the cover protrusion 391. A circumferential portion reinforcing portion 392*a* recessed along the cover circumferential portion 392 may be disposed on the cover circumferential portion 392. In addition, a fixing member opening 392*b* in which the panel fixing member 38 is installed may be defined in each of both left and right sides of the cover circumferential portion 392. The panel fixing member 38 may be fixed to the back cover 39 and may protrude backward to be coupled to the fixing member coupling portion 413 of the front surface of the door body 40.

In addition, upper and lower ends of cover circumferential portion 392 may be coupled to the upper bracket 34 and the lower bracket 35, and left and right ends of the cover circumferential portion 392 may be coupled to the side surface portion 322.

In detail, a plurality of forming portions 397 may be disposed along the upper and lower ends of the cover circumferential portion 392. Each of the forming portions 397 may protrude backward, and a bracket boss 352*d* in which the lower bracket screw hole 352*c* is defined may be disposed inside the forming portion 297. In addition, a cover screw hole 397*a* to which the screw 397*b* is coupled may be defined in the forming portion 397.

In addition, the protrusion opening 395 through which the upper protrusion 343 protruding backward from the rear surface of the upper bracket 34 passes when the upper bracket 34 is mounted may be defined in the upper end of the back cover 39.

The forming portion 397 and the cover screw hole 397*a* may be defined at positions corresponding to the lower bracket screw hole 352*c* along the lower end of the cover circumferential portion 392, and the screw 397*b* may be coupled to allow the lower bracket 35 and the lower end of the back cover 39 to be coupled to each other.

The overall restricting structure of the panel assembly 30 may be completed by coupling the screw 397*b*, and the fixing member 32 and the light guide plate 33 may also be restricted by coupling the upper bracket 34, the lower bracket 35, and the back cover 39.

In addition, the wire entrance 398 may be further provided at the lower end of the cover circumferential portion 392. The wire entrance 398 may be disposed at a position corresponding to the connector hole 452*a* and may be provided by cutting the lower end of the back cover 39.

In addition, a cover support portion 396 may be disposed at a lower end of the cover circumferential portion 392, i.e., at the lower end of the back cover 39. The cover support portion 396 may be bent backward. Accordingly, the cover support portion 396 may be referred to as a bending portion. Also, the cover support portion 396 may be formed together when the back cover 39 is formed.

The cover support portion 396 may be configured to more firmly support and couple the panel assembly 30 when the panel assembly 30 is mounted to the door body 40 and may be in contact with the bracket support portion 356 to reinforce strength of the bracket support portion 356.

The cover support portion 396 may be bent to be perpendicular to the rear surface of the back cover 39. In addition, the cover support portion 396 may extend from one end to the other end of the lower end of the back cover 39. In addition, the cover support portion 396 may extend backward so that at least a portion of the cover support portion 396 overlaps the lower support portion 451*b* of the lower cap decoration 45.

The cover support portion 396 may further include a cover coupling portion 396*c*. The cover coupling portion 396*c* that further protrudes backward may be disposed on the cover support portion 396. The cover coupling portion 396*c* may be disposed at a position corresponding to the lower opening 453 and may extend to be inserted into the lower opening 453. The cover support portion 396 and the cover coupling portion 396*c* may also be called a cover bending portion.

A plurality of the cover coupling portions 396*c* may be disposed to be spaced apart from each other along the cover support portion 396. In addition, the cover coupling portion 396*c* may be provided in a shape corresponding to the bracket coupling portion 357 disposed on the lower bracket bottom surface portion 354 and may be seated on the bracket coupling portion 357. That is, in the state in which the panel assembly 30 is assembled, the cover support portion 396 and the cover coupling portion 396*c* may be in close contact with a top surfaces of the bracket support portion 356 and the bracket coupling portion 357. In addition, when the panel assembly 30 is mounted on the door body 40, the cover support portion 396 and the cover coupling portion 396*c* may be inserted into the lower opening 453 in a state of being seated on the bracket support portion 356 and the bracket coupling portion 357.

A coupling hole 396*d* through which the coupling member 457 coupled to a bottom surface of the door body 40 passes may be defined in the cover coupling portion 396*c*. In addition, a bracket coupling hole 357*a* may be defined in the bracket coupling portion 357 at a position corresponding to the coupling hole 396*d*. Thus, the coupling member 457 may be disposed to sequentially pass through the bracket coupling hole 357*a* and the coupling hole 396*d*.

A bracket hook portion 354*a* protruding downward may be formed on the lower bracket bottom surface portion 354. The bracket hook portion 354*a* may be disposed more forward than the cover support portion 396, and when the panel assembly 30 is mounted on the door body 40, the bracket hook portion 354*a* may be hooked on a front end of the lower support portion 451*b* to guide a mounting position of the panel assembly 30.

That is, when the bracket hook portion 354*a* is hooked and restricted on the front end of the lower support portion 451*b* when the panel assembly 30 is mounted, the lower end of the panel assembly 30 may be disposed at a fixed position. Here, the cover support portion 396 and the bracket support portion 356 may become a state of being supported by the lower support portion 451*b*, and the cover coupling portion 396*c* and the bracket coupling portion 357 may become a state of being inserted into the lower opening 453. In addition, the coupling hole 396*d* and the bracket coupling hole 357*a* may be aligned so that the coupling member 457 is coupled.

Hereinafter, the state in which the lower end of the panel assembly 30 having the above structure is fixed will be described in more detail with reference to the drawings.

Figure 16:
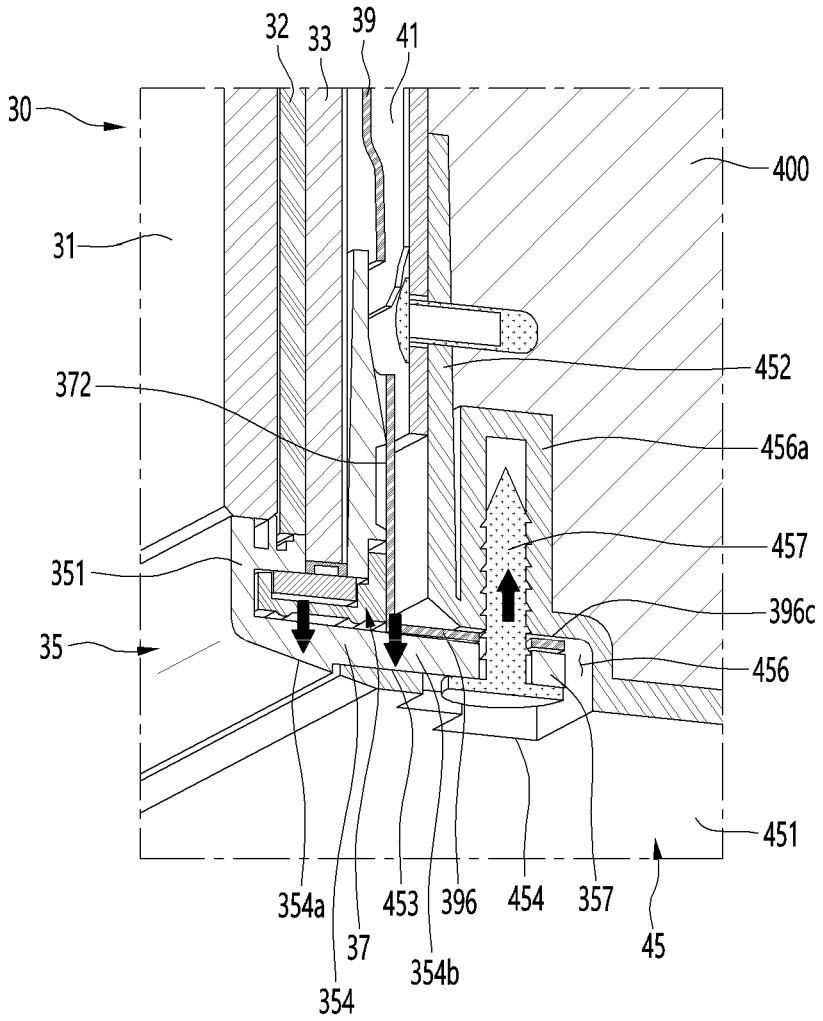
FIG. 16 is a cutaway perspective view taken along line XVI-XVI' of FIG. 3.

Also, FIG. 16 is a cutaway perspective view taken along line XVI-XVI' of FIG. 3.

To mount the panel assembly 30 on the door body 40, the lower end of the panel assembly 30 may be first supported on the lower end of the lower cap decoration 45, and then, the upper end of the panel assembly 30 may rotate backward so that the upper protrusion 343 is restricted on the upper mounting portion 431. Then, the coupling member 457 may be coupled to the bottom surface of the lower cap decoration 45 to further fix the lower end of the panel assembly 30 and the door body 40, thereby completing the mounting of the panel assembly 30.

In addition, to separate the panel assembly 30 from the door body 40, after the coupling member 457 is separated, first, the upper protrusion 343 may rotate forward to be separated from the upper mounting portion 431, and then, the panel assembly 30 may be lifted to completely separate the panel assembly 30 from the door body 40.

In the state in which the panel assembly 30 is mounted, the lower end of the panel assembly 30 may remain in a state of being firmly coupled to the door body 40 and may distribute and support a load of the panel assembly 30.

In detail, the cover support portion 396 and the cover coupling portion 396*c* protruding toward the door body 40 in the state in which the panel assembly 30 is assembled may become in a state of overlapping the top surfaces of the bracket support portion 356 and the bracket coupling portion 357. Here, at least one of the cover support portion 396, the cover coupling portion 396*c*, the bracket support portion 356, or the bracket coupling portion 357, which protrudes to the rear side of the panel assembly 30, may be referred to as a coupling portion. In addition, the coupling portion may be supported on the lower cap decoration bottom surface 451, and simultaneously, at least a portion of the coupling portion may be inserted to pass through the front surface of the lower cap decoration 45.

In the state in which the panel assembly 30 is mounted, the lower support portion 451*b* may support the bracket support portion 356 and the cover support portion 396 from the lower side. Here, the panel 31, the fixing member 32, and the light guide plate 33 may be disposed at a front side with respect to the lower support portion 451*b*, and a center of gravity of at least the panel assembly 30 may be disposed in front of the lower support portion 451*b*.

In this state, the rear surface of the back cover 39 may be disposed vertically above the lower support portion 451*b*, and the bracket coupling portion 357 and the cover coupling portion 396*c* may pass through the lower support portion 451*b* and then be inserted into the lower opening 453.

In the insertion part 456 of the lower opening 453, the bracket coupling portion 357 and the cover coupling portion 396*c* may be supported by the lower cap decoration 45. In detail, due to the supporting of the lower support portion 451*b* and the front arrangement of the center of gravity of the panel assembly 30, the bracket coupling portion 357 and the cover coupling portion 396*c* may be applied with upward force and be in contact with the top surface of the insertion part 456 so as to be restricted.

Therefore, even in the situation in which the weight of the panel assembly 30 is heavy, the panel assembly 30 may be prevented from being sagged due to the primary supporting by the lower support portion 451*b* and the secondary supporting of the bracket coupling portion 357 and the cover coupling portion 396*c*.

In the state in which the bracket coupling portion 357 and the cover coupling portion 396*c* are inserted into the lower opening 453, the coupling member 457 may be inserted through the screw hole 454 that is opened in the lower bracket bottom surface portion 354. In addition, the coupling member 457 may pass through the bracket coupling hole 357*a* and the coupling hole 396*d* and then may be coupled to the screw boss 456*a* disposed on the top surface of the insertion part 456.

Thus, the bracket coupling portion 357 and the cover coupling portion 396*c* may be maintained in the fixed state of being in close contact with the top surface of the insertion part 456 while being inserted into the lower opening 453, and thus, the panel assembly 30 may be additionally fixed.

Hereinafter, the operations of the refrigerator 1 and the panel assembly 30 having the above structures will be described in more detail with reference to the drawings.

Figure 17:
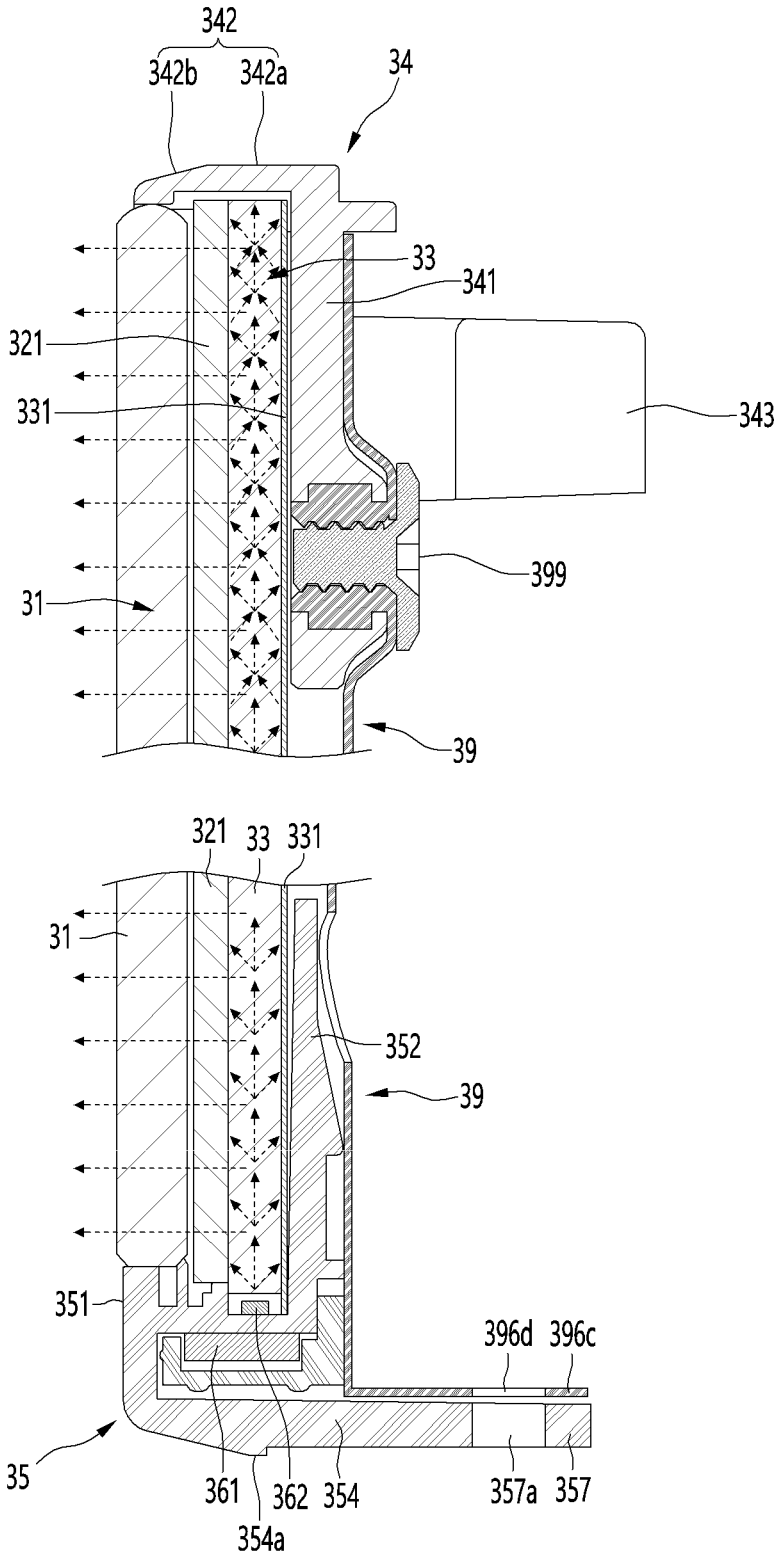
FIG. 17 is a cross-sectional view illustrating an emission state of the panel assembly.
Figure 18:
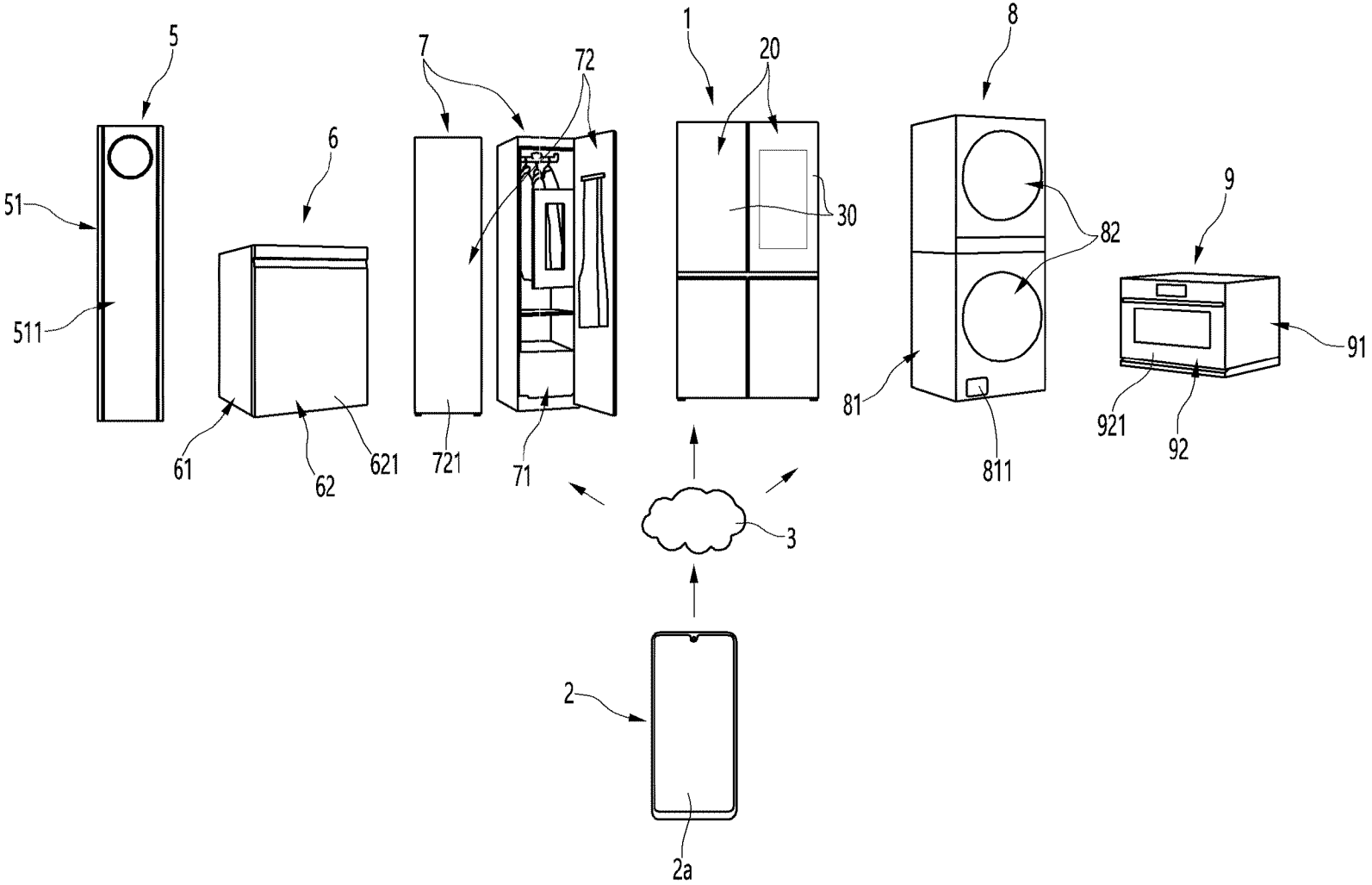
FIG. 18 is a view illustrating an example of adjusting colors of home appliances to which the panel assembly using a remote device is applied.
Figure 19:
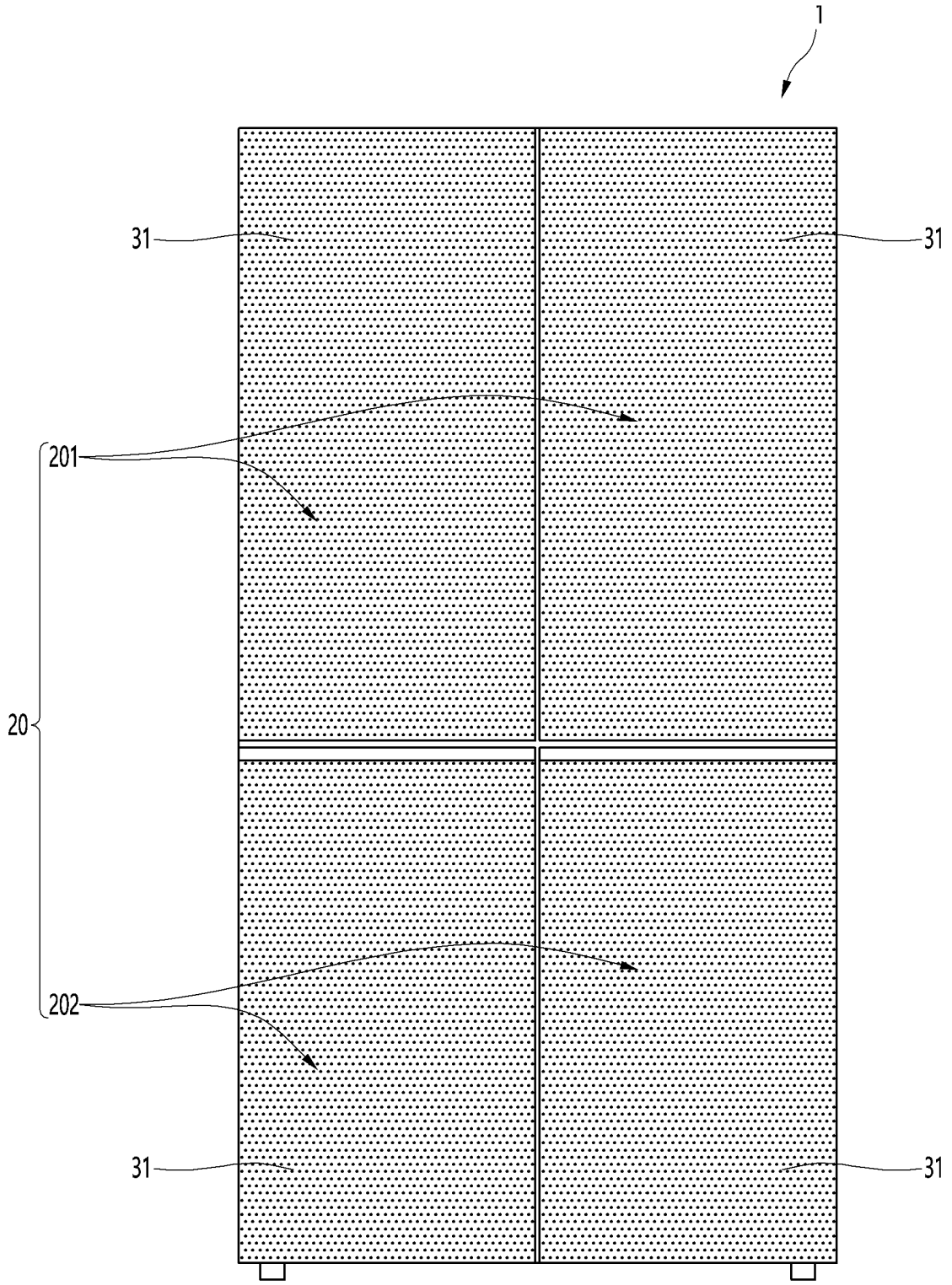

FIG. 17 is a cross-sectional view illustrating an emission state of the panel assembly, i.e., a cross-sectional view taken along line XVII-XVII' of FIG. 4. Also, FIG. 18 is a view illustrating an example of adjusting colors of home appliances to which the panel assembly using a remote device is applied. Also, FIG. 19 is a front view illustrating an outer appearance of the front surface of the refrigerator that is in a state in which the lighting device is turned on.

As illustrated in the drawing, an outer appearance of the home appliance according to an embodiment may be defined by the panel assembly 30, and also, a color of the outer appearance of the home appliance may be changed to a color that is set by the user according to the operation of the lighting device 36. The panel assembly may be expressed in various colors by light irradiated from the rear side, and thus the panel assembly 30 or the panel 31 may be referred to as a screen.

The home appliance may be any one of a refrigerator 1, an air conditioner 5, a dishwasher 6, a clothes manager 7, a washing machine 8, or a cooking appliance 9, each of which has a front surface of which a color of an outer appearance is freely changed by applying the same structure as the panel assembly 30 according to an embodiment.

For example, in the above-described embodiment and in the refrigerator 1, the panel assembly 30 may be provided on a front side of the door 20 that opens and closes the cabinet 10. In addition, the panel assembly 30 may shine in a set color by user setting, and the outer appearance of the front surface of the refrigerator 1 may be changed in color.

As another example, an indoor unit of the air conditioner 5 may have a space in which a heat exchange device and a fan are provided inside a case 51 (or cabinet) that defines an outer appearance of the indoor unit. In addition, a front surface of the case 51 may be defined by a panel assembly 511. The panel assembly 511 may have the same structure as the panel assembly 30 of the refrigerator 1 to emit light.

Thus, the panel assembly 511 may shine in a set color by the user setting, and a color of the outer appearance of the front surface of the indoor unit of the air conditioner 5 may be changed into the set color.

As another example, in the dishwasher 6, a space for washing dishes may be defined inside a case 61 or a cabinet that defines an outer appearance of the dishwasher 6. In addition, the front surface of the case 61 may be opened and closed by the door 62, and the front surface of the door 62 may be defined by the panel assembly 621. The panel assembly 621 may have the same structure as the panel assembly 30 of the refrigerator 1 to emit light.

Thus, the panel assembly 621 may shine in a set color by the user setting, and a color of the outer appearance of the front surface of the dishwasher 6 may be changed into the set color.

As another example, in the clothes manager 7, a space for storing clothes may be defined inside a case 71 or a cabinet that defines an outer appearance of the clothes manager 7. In addition, the front surface of the case 71 may be opened and closed by the door 72, and the front surface of the door 72 may be defined by the panel assembly 721. The panel assembly 721 may have the same structure as the panel assembly 30 of the refrigerator 1 to emit light.

Thus, the panel assembly 721 may shine in a set color by the user setting, and a color of the outer appearance of the front surface of the clothes manager 7 may be changed into the set color.

As another example, in the washing machine 8 or a dryer, a space for washing or drying may be defined inside a case 81 (or cabinet) that defines an outer appearance of the washing machine 8. In addition, a front of the case 81 may be opened and closed by the door 82. The front surface of the case 81 may be defined by a panel assembly 811. The panel assembly 811 may have the same structure as the panel assembly 30 of the refrigerator 1 to emit light.

Thus, the panel assembly 30 may shine in a set color by the user setting, and a color of the outer appearance of the front surface of the washing machine 8, the dryer, or the air conditioner 5 may be changed into the set color.

As another example, in the cooking appliance 9, a space for cooking food may be defined inside a case 91 or a cabinet that defines an outer appearance of the cooking appliance. In addition, the front surface of the case 91 may be opened and closed by the door 92, and the front surface of the door 92 may be defined by the panel assembly 921. The panel assembly 921 may have the same structure as the panel assembly 30 of the refrigerator 1 to emit light.

Thus, the panel assembly 921 may shine in a set color by the user setting, and a color of the outer appearance of the front surface of the cooking appliance 9 may be changed into the set color.

A process of changing the color of the panel assembly 30 will be described below.

In a state in which the lighting device 36 is turned off, a color of the outer appearance of the front surface may be expressed by the color of the panel 31. A color displayed on the panel 31 in the state in which the lighting device 36 is turned off may be referred to as a first color.

When the lighting device 36 operates, the color of the panel 31 may be changed according to a color of light irradiated from the lighting device 36, and a color of the outer appearance of the front surface of the door 20 may be expressed in the selected color. Here, the color displayed through the panel by the light irradiated from the lighting device 36 may be referred to as a second color.

The color of the panel 31 may be determined by an operation of the lighting device 36. For example, the lighting device 36 may also be manipulated and set through a remote device 2 spaced apart from the refrigerator 1. The refrigerator 1 may communicate with the remote device 2 through a communicator 17 connected to a controller 13, and the user may manipulate an operation of the lighting device 36 through the remote device 2.

The communicator 17 may communicate with the remote device 2 using various methods. For example, the remote device 2 may be various devices that are capable of communicating, such as a dedicated terminal, a mobile phone, a tablet, a portable PC, a desktop PC, a remote control, or a Bluetooth speaker.

The user may manipulate and set the overall operation state of the lighting device 36, such as an operation time and an operation condition of the lighting device 36 and emission color through manipulation of the remote device 2. For example, the lighting device 36 may be simply manipulated and set through an application or a dedicated program installed in a portable phone of the user. That is, the user may select a desired color of the panel 31 through a screen 2*a* of the remote device 2 such as a mobile phone or a terminal.

In addition, the user may input a color through a manipulation portion provided in the refrigerator 1 without using the remote device 2.

In addition, each of the refrigerator 1 and the remote device 2 may be connected to a server in a network state, and thus, the color of the panel 31 of the refrigerator 1 may be input through the server 3.

The operation state of the lighting device 36 is now described. As illustrated in FIG. 17, when the lighting device 36 is turned on, light emitted from the LED 362 may be emitted toward the lower end of the light guide plate 33.

The light incident through the lower end of the light guide plate 33 may be diffused and reflected along the light guide plate 33 and then may move along the light guide plate 33. In this case, the light guided by the light guide plate 33 may be reflected forward by the reflective layer 331 to pass through the panel 31 so as to be transmitted to the outside.

Light directed forward through the light guide plate 33 may pass through the fixing member 32 to illuminate the panel 31, and the front surface of the door 20 may shine with a set brightness or color.

For example, in the state in which the lighting device 36 is turned off, as illustrated in FIG. 1, a front surface of the door 20 may not shine, and an original color of the panel assembly 30 may appear.

The panel assembly 30 may have a structure that is separable from the door body 40, and thus, the user may select a color of the front panel 31 by mounting the panel assembly 30 having a desired color. Of course, if necessary, the user may change the color of the panel 31 when the lighting device 36 is turned off by exchanging the panel assembly 30 itself.

Thus, the front surface of the door 20 may be seen with the first color that is the color of the panel 31. In this case, components inside the panel assembly 30 may be seen through the panel 31 and may not be seen to the outside by the color of the panel 31.

In this state, the lighting device 36 may be turned on, and when the lighting device 36 is turned on, the front surface of the door 20 may shine with a color set by the user.

For example, as illustrated in FIG. 19, the controller may control the front surface of the door 20 to shine with a second color different from the first color, and the lighting device 36 may cause the LED 362 to shine with the set color according to the control of the controller. Here, the color of the panel 31 may be selected by the user, and the color of the panel 31 may be selected by the manipulation of the remote device 2 or the manipulation of the manipulation portion 14.

In the state in which the outer appearance of the front surface of the refrigerator 1 shines with the set color, when the controller instructs change in color of the front surface of the refrigerator 1, the front surface of the panel 31 may shine with a color that is reset by the controller.

In addition, the panels 31 constituting some of the plurality of doors 20 defining the outer appearance of the front surface of the refrigerator 1 may emit light, or the panels 31 constituting the plurality of doors 20 may independently emit light with different colors to define the outer appearance of the front surface of the refrigerator 1.

There may be various other embodiments other than the aforementioned embodiments. Another embodiment of the present disclosure is characterized in that a cover support portion of a lower end of a back cover is bent several times. In another embodiment of the present disclosure, other constitutes except for the cover support portion have the same structure as those in the foregoing embodiment, and thus, the same reference numerals are used for the same constitute, and detailed descriptions thereof will be omitted.

Hereinafter, another embodiment of the present disclosure will be described with reference drawings.

Figure 20:
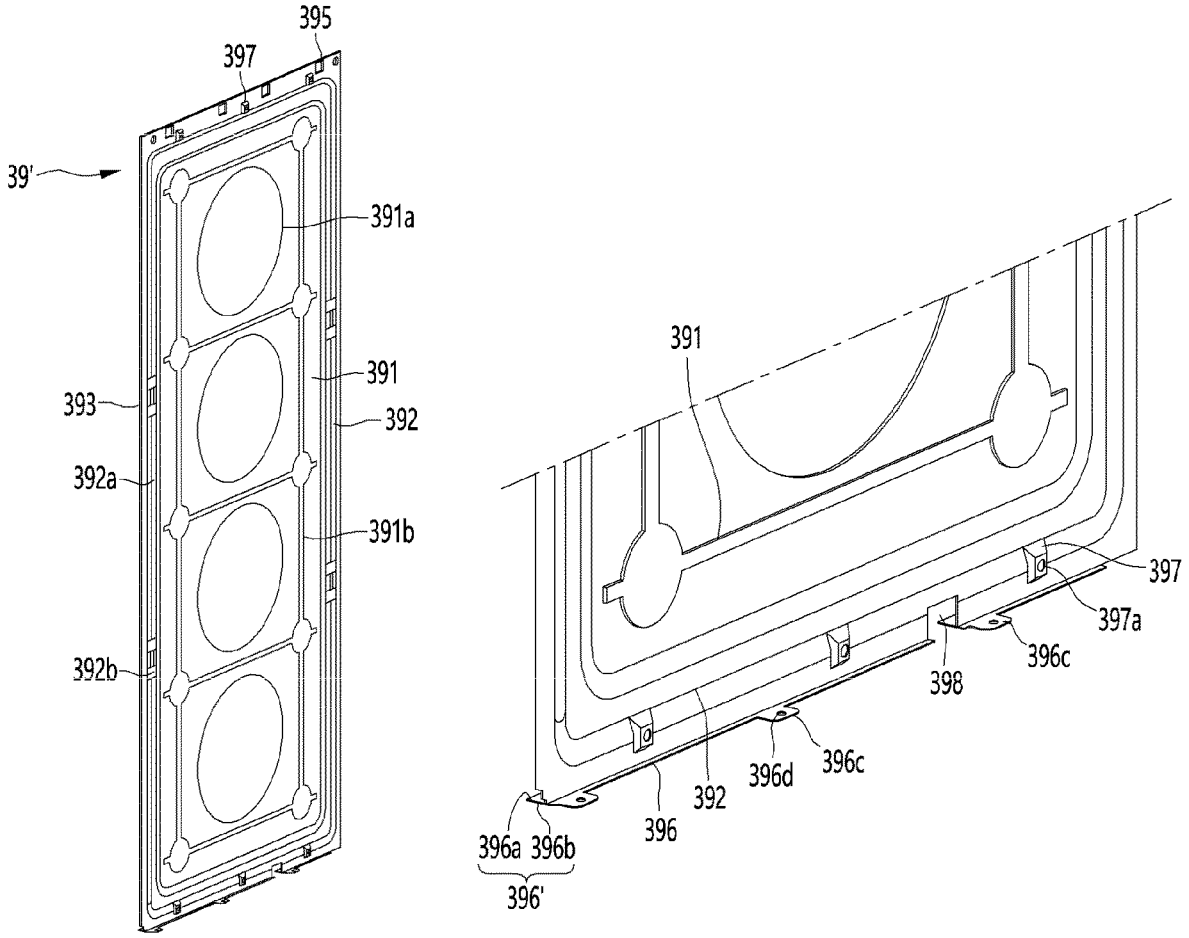
FIG. 20 is a rear perspective view of a back cover according to another embodiment of the present invention.
Figure 21:
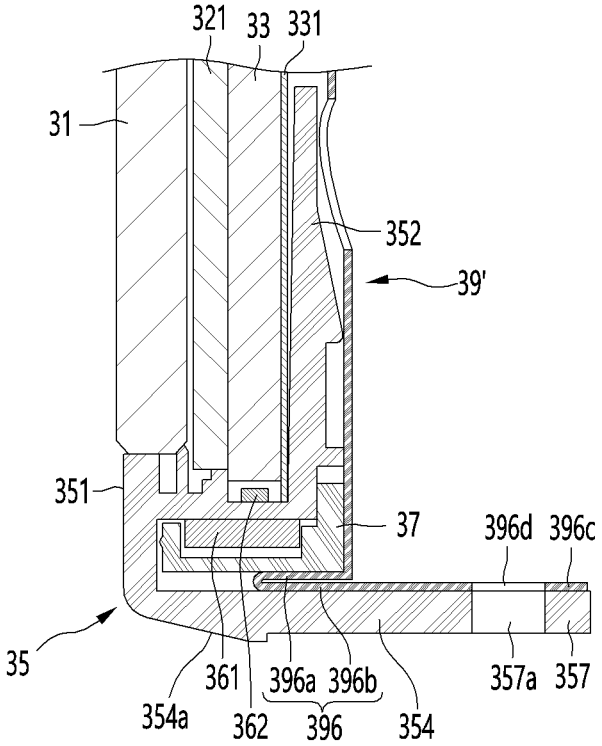
FIG. 21 is a cross-sectional view illustrating a lower end of a panel assembly according to another embodiment.

FIG. 20 is a rear perspective view of a back cover according to another embodiment of the present invention. FIG. 21 is a rear perspective view of a panel assembly according to another embodiment.

As illustrated in the drawings, a panel assembly 30 according to another embodiment may have the same structure as the above-described embodiment except for a shape of a back cover 39', particularly, a cover support portion 396'.

The back cover 39' may be provided in the form of a metal plate and includes a cover protrusion 391 supporting a light guide plate 33 and a cover circumferential portion 392 disposed along a circumference of the cover protrusion 391.

A plurality of the cover holes 391*a* may be defined in the cover protrusion 391, and a protrusion reinforcing portion 391*b* may be provided. In addition, a circumferential portion reinforcing portion 392*a*, a forming portion 397, a protrusion opening 395, a fixing member opening 392*b*, and a wire entrance 398 may be disposed on the cover circumferential portion 392.

A cover side surface 393 may be disposed on each of both left and right ends of the back cover 39'. The cover side surface 393 may be disposed to extend forward from each of both the left and right ends of the back cover 39'. The cover side surface 393 may be coupled to a side surface portion 322 of the fixing member 32, and both the left and right ends of the back cover 39' may be restricted to the fixing member 32.

A cover support portion 396' may be further disposed on a lower end of the cover circumferential portion 392. The cover support portion 396' may be provided by bending the lower end of the cover circumferential portion 392, i.e., the lower end of the back cover 39' several times and may have a structure that is capable of supporting a lighting device 36 and fixedly mounting a lower end of the panel assembly 30.

In detail, the cover support portion 396' may be provided by continuously bending the lower end of the back cover 39' forward and backward and may include a first support portion 396*a* defining a top surface of the cover support portion 396' and a second support portion 396*b* defining a bottom surface of the cover support portion 396'.

The first support portion 396*a* may be provided to be bent forward at the lower end of the back cover 39'. The first support portion 396*a* may be inserted into the bracket opening 352*a* and may support the lighting device 36 from the lower side.

In addition, the first support portion 396*a* may extend inside the lower bracket 35 and may extend to overlap at least a portion of a substrate 361 of the lighting device 36.

The extending end of the first support portion 396*a* may be bent backward to provide the second support portion 396*b*. The second support portion 396*b* may be bent to be in contact with a bottom surface of the first support portion 396*a* and may extend backward. The second support portion 396*b* may extend backward from the inside of the lower bracket 35 and may further extend backward through the bracket opening 352*a*.

Thus, the lighting device 36 may be supported in the shape in which the first support portion 396*a* and the second support portion 396*b* overlap each other in the lower bracket 35, and thus, strength of the lower portion of the panel assembly 30 may be reinforced in the lower bracket 35.

The second support portion 396*b* may protrude backward via a rear surface of the back cover 39'. The second support portion 396*b* may extend backward to be seated on the lower support portion 451*b* of a lower cap decoration 45.

A cover coupling portion 396*c* protruding backward may be disposed on the second support portion 396*b*. The cover coupling portion 396*c* may protrude backward from the second support portion 396*b*, and a plurality of the cover coupling portions 396*c* may be disposed along the left and right sides of the lower end of the back cover 39'. In addition, the cover coupling portion 396*c* may extend to support the bottom surface of the door body 40 from the lower side.

The second support portion 396*b* and the cover coupling portion 396*c* may be seated on top surfaces of the bracket support portion 354*b* and the bracket coupling portion 357, which are disposed on the lower bracket 35. In addition, the cover coupling portion 396*c* may extend to be inserted into the lower opening 453.

In addition, a coupling hole 396*d*, into which the coupling member 457 is inserted, and the bracket coupling hole 357*a* may be defined in the cover coupling portion 396*c* and the bracket coupling portion 357. Thus, in the state in which the cover coupling portion 396*c* and the bracket coupling portion 357 are inserted inside the lower opening 453, the coupling member 457 coupled to the screw hole 454 below the lower cap decoration 45 may pass through the bracket coupling hole 357*a* and the coupling hole 396*d* and then be coupled to the lower cap decoration 45.

The cover coupling portion 396*c* and the bracket coupling portion 357 may be firmly fixed inside the lower opening 453 by the coupling of the coupling member 457 to restrict the lower end of the panel assembly 30. In addition, a load of the panel assembly 30 may be stably supported.

There may be various other embodiments other than the aforementioned embodiments. Another embodiment of the present disclosure is characterized in that a cover support portion is directly supported on a substrate. Another embodiment of the present disclosure may have the same structure as the aforementioned embodiment except for a coupling relationship between a substrate and the cover support portion, and thus the same components as in the aforementioned embodiment use the same reference numeral, and a detailed description thereof may be omitted.

Hereinafter, another embodiment of the present disclosure will be described with reference drawings.

Figure 22:
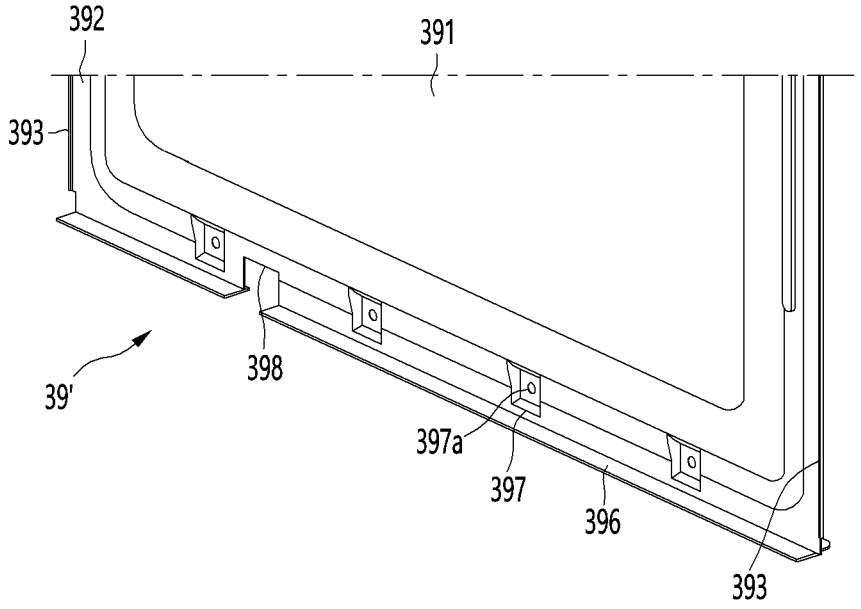
FIG. 22 is a front perspective view of a back cover according to further another embodiment.
Figure 23:
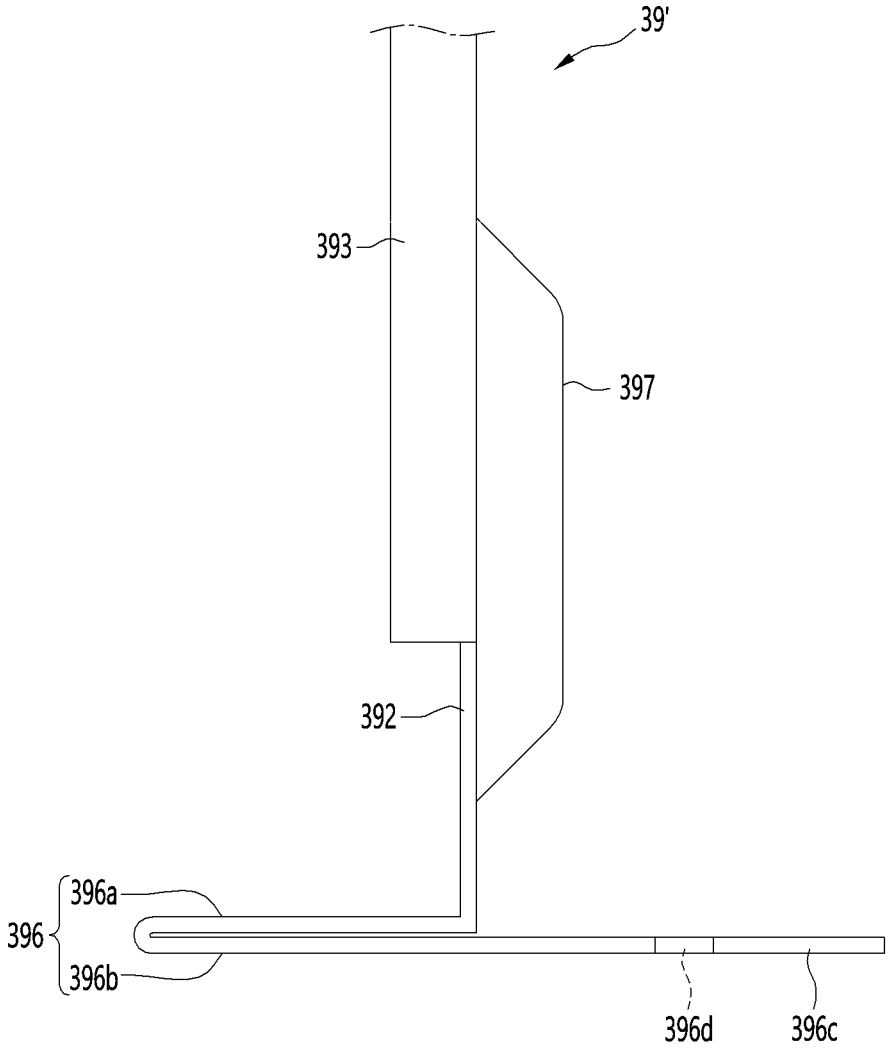
FIG. 23 is a side view illustrating the lower end of the back cover.
Figure 24:
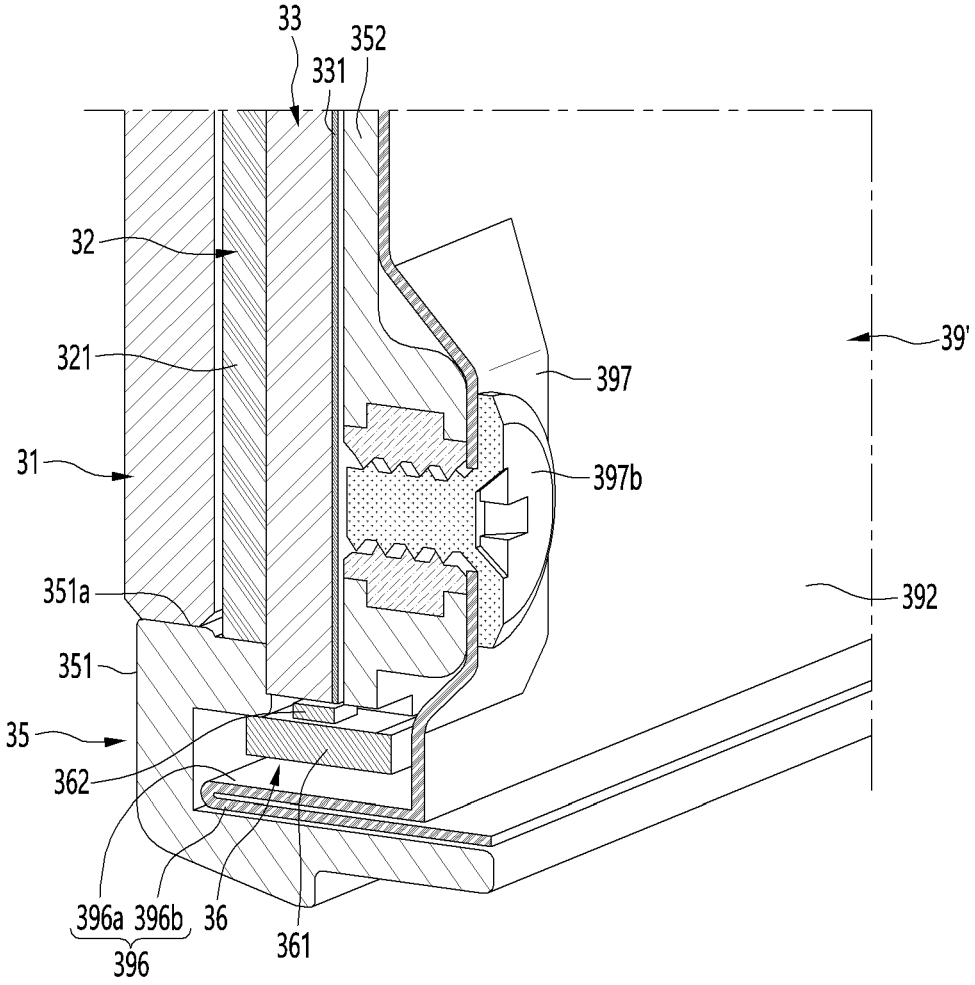
FIG. 24 is a cutaway perspective view illustrating a lower end of a panel assembly according to further another embodiment.

FIG. 22 is a front perspective view of a back cover according to further another embodiment. Also, FIG. 23 is a side view illustrating the lower end of the back cover. Also, FIG. 24 is a cutaway perspective view illustrating a lower end of a panel assembly according to further another embodiment.

As illustrated in the drawings, a rear surface of a panel assembly 30 according to another embodiment may be defined by a back cover 39'. An overall shape of the back cover 39' may be the same as in the other embodiments described above.

The back cover 39' may include a cover protrusion 391 and a cover circumferential portion 392. In addition, a cover side surface 393 may be defined on each of both left and right ends of the back cover 39'. The cover side surface 393 may be disposed to extend forward and may be mounted on a fixing member 32.

The cover protrusion 391 may support a rear surface of a light guide plate 33. In addition, the cover circumferential portion 392 may define a circumference of the back cover 39'. In addition, upper and lower ends of the cover circumferential portion 392 may be coupled to a upper bracket 34 and a lower bracket 35, and left and right ends of the cover circumferential portion 392 may be coupled to both surfaces of the fixing member 32.

A cover screw hole 397*a* to which a plurality of screws 397*b* are coupled may be defined along each of the upper and lower ends of the cover circumferential portion 392. The upper bracket 34 and the lower bracket 35 may be coupled to a back cover 39' by coupling the screw 397*b*.

The cover screw hole 397*a* may be defined in a forming portion 397 protruding backward along the cover circumferential portion 392. In addition, the forming portion 397 may be provided to accommodate a portion to which the screws 397*b* of the upper bracket 34 and the lower bracket 35 are coupled.

A wire entrance 398 may be provided in the lower end of the cover circumferential portion 392. In addition, a cover support portion 396 may be further disposed on the lower end of the cover circumferential portion 392. The cover support portion 396 may be provided by bending the lower end of the back cover 39' several times. In addition, the cover support portion 396 may support a lighting device 36. In addition, the cover support portion 396 may have a structure in which a lower end of the panel assembly 30 is supported and fixedly mounted on a door body 40.

In detail, the cover support portion 396' may be provided by continuously bending the lower end of the back cover 39' forward and backward and may include a first support portion 396*a* defining a top surface of the cover support portion 396' and a second support portion 396*b* defining a bottom surface of the cover support portion 3961.

The first support portion 396*a* may be provided to be bent forward at the lower end of the back cover 39'. The first support portion 396*a* may be inserted into the bracket opening 352*a* and may support the lighting device 36 from the lower side. Here, the back cover 39' may be made of a metal material so that heat of the lighting device 36 is conducted and also is dissipated through a rear surface of the back cover 39'.

In addition, the first support portion 396*a* may extend up to an inner front surface of the lower bracket 35, and the extending end of the first support portion 396*a* may be bent backward to provide the second support portion 396*b*.

The second support portion 396*b* may be bent to be in contact with a bottom surface of the first support portion 396*a* and may extend backward. The second support portion

396*b* may extend backward from the inside of the lower bracket 35 and may further extend backward through the bracket opening 352*a*.

Thus, the lighting device 36 may be supported in the shape in which the first support portion 396*a* and the second support portion 396*b* overlap each other in the lower bracket 35, and thus, strength of the lower portion of the panel assembly 30 may be reinforced in the lower bracket 35.

While the back cover 39' moves forward toward the fixing member 32 and then mounted, the cover support portion 396 may be inserted through the bracket opening 352*a*. In addition, in the state in which the back cover 39' is fully coupled to the fixing member 32, a top surface of the cover support portion 396 may support a bottom surface of the substrate 361 of the lighting device 36 from the lower side. In addition, the cover support portion 396 may reinforce strength of the lower end of the panel assembly 30 while being inserted into the lower bracket 35.

The cover support portion 396 may extend up to a front end of the substrate 361. In addition, the cover support portion 396 may extend to an inner front surface of the bracket opening 352*a*. Thus, the cover support portion 396 may support the bottom surface of the substrate 361 as a whole, thereby improving heat transfer efficiency.

Of course, if necessary, the cover support portion 396 may extend to support a portion of the substrate 361 from the lower side.

The second support portion 396*b* may protrude backward via the rear surface of the back cover 39'. The second support portion 396*b* may protrude more backward than the forming portion 397, and the lower end of the panel assembly 30 may be coupled to a lower end of the door body 40.

That is, a cover coupling portion 396*c* that further protrudes backward may be disposed on the second support portion 396*b*. The cover coupling portion 396*c* may be disposed on the second support portion 396*b* extending outside the lower bracket 35. A plurality of cover coupling portions 396*c* may be disposed along the left and right sides of the lower end of the back cover 39', In addition, the cover coupling portion 396*c* may extend to support the bottom surface of the door body 40 from the lower side. The cover support portion 396 and the cover coupling portion 396*c* may also be called a cover bending portion.

A coupling hole 396*d* passing through a center of the cover coupling portion 396*c* may be defined in the cover coupling portion 396*c*, and a coupling member 457 passing through the coupling hole 396*d* may be coupled to the cover coupling portion 396*c*. The coupling member 457 may be, for example, a screw, and the coupling member 457 may sequentially pass through a bottom surface of the lower bracket 35 and the coupling hole 396*d* and then be coupled to the door body 40 so that the lower end of the panel assembly 30 is fixedly mounted on the door body 40.

The home appliance according to the proposed embodiments may have the following effects.

According to the embodiment, the cover support part protruding backward from the lower end of the back cover may be fixed to the lower end of the door body. Thus, even though the weight of the panel assembly increases, the panel assembly may not be sagged and be maintained in the stably mounted state.

Particularly, the cover support portion may be provided by bending the back cover, and thus, the back cover may be pulled to simply cover support without coupling or assembling the additional component.

In addition, the cover support portion may be made of the metal material to reinforce the sagging load of the panel assembly, and thus, the stably mounted state may be maintained even when the large and heavy panel is used.

In addition, the cover support portion may be bent several times to become thicker, and there may be the advantage in that the reinforcing structure configured to support the load of the panel assembly may be more firmly configured.

In addition, the cover support portion may further include the cover coupling portion protruding backward, and the cover coupling portion may be coupled to the lower cap decoration to additionally support the panel assembly having the center of gravity, which is defined at the front side thereof.

In addition, there may be the advantage in that the panel assembly is more firmly fixed by coupling the coupling member passing through the cover coupling portion so that the cover coupling portion is firmly coupled to the lower end of the door body.

In addition, when the panel assembly is detached, the cover coupling portion and the cover support portion may be simply separated from the door body after releasing the coupling member, and thus, the panel assembly may be more easily detached.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An appliance comprising:

a cabinet that defines a storage space; and a door configured to open and close at least a portion of the storage space, the door comprising a door body and a panel assembly that is disposed on the door body, wherein the panel assembly comprises:

a lighting device configured to output light, a panel that defines a front surface of the door and is configured to transmit the light with a set color, a back cover that defines a rear surface of the panel assembly, the back cover comprising a cover support portion that is disposed at a lower end of the back cover and extends rearward from the rear surface of the panel assembly toward the door body, and a lower bracket that defines a bottom surface of the panel assembly, the lower bracket comprising a bracket protrusion that extends toward the door body and supports the cover support portion.

2. The appliance according to claim 1, wherein the back cover is made of a metal material.

3. The appliance according to claim 2, wherein the cover support portion is bent from the lower end of the back cover.

4. The appliance according to claim 1, wherein the door body comprises a lower support portion that protrudes forward and supports a lower end of the panel assembly, and wherein the cover support portion is disposed on the lower support portion.

5. The appliance according to claim 1, wherein a bottom surface of the cover support portion is in contact with a top surface of the bracket protrusion.

6. The appliance according to claim 1, wherein the door body defines a lower opening at a front surface of the door body, the lower opening being configured to, based on the panel assembly being coupled to the door body, receive the cover support portion and the bracket protrusion.

7. The appliance according to claim 6, wherein the door further comprises a coupling member disposed at a bottom surface of the door body and passes through the bracket protrusion and the cover support portion that are inserted into the lower opening.

8. The appliance according to claim 1, wherein the back cover further comprises a cover coupling portion that extends rearward from the cover support portion toward the door body, and wherein the cover coupling portion passes through a front surface of the door body and is inserted into the door body.

9. The appliance according to claim 8, wherein the cover support portion extends along the lower end of the back cover from a first end of the back cover to a second end of the back cover, and wherein the cover coupling portion is one of a plurality of cover coupling portions that are arranged along the cover support portion and spaced apart from one another.

10. The appliance according to claim 8, wherein the cover coupling portion defines a coupling hole, and wherein the door further comprises a coupling member that passes through the coupling hole and is coupled to a bottom surface of the door body.

11. The appliance according to claim 10, wherein the door body comprises a lower support portion that protrudes forward from the bottom surface of the door body and supports a lower end of the panel assembly, wherein the panel is disposed forward relative to the lower support portion, and wherein the coupling member is disposed rearward relative to the lower support portion and faces the lower support portion of the door body.

12. An appliance comprising:

a cabinet that defines a storage space; and a door configured to open and close at least a portion of the storage space, the door comprising a door body and a panel assembly that is disposed on the door body, wherein the panel assembly comprises:

a lighting device configured to output light, a panel that defines a front surface of the door and is configured to transmit the light with a set color, and a back cover that defines a rear surface of the panel assembly, the back cover comprising a cover support portion that is disposed at a lower end of the back cover and extends rearward from the rear surface of the panel assembly toward the door body, and wherein the cover support portion comprises:

a first support portion that extends forward from the lower end of the back cover; and a second support portion that is bent rearward from a front end of the first support portion and extends rearward relative to a rear end of the first support portion toward the door body.

13. The appliance according to claim 12, wherein the panel assembly further comprises a lower bracket that defines a bottom surface of the panel assembly and accommodates the lighting device, the lower bracket defining a bracket opening that provides access to the lighting device.

14. The appliance according to claim 13, wherein the back cover covers at least a portion of the bracket opening.

15. The appliance according to claim 13, wherein the first support portion is inserted into the bracket opening and supports a lower side of the lighting device.

16. The appliance according to claim 13, wherein the lower bracket comprises a light supporter that is made of a metal material and supports the lighting device, and wherein the light supporter is exposed through the bracket opening and is in contact with the back cover, the light supporter being configured to transfer heat of the lighting device to the back cover.

17. The appliance according to claim 16, wherein the first support portion is inserted into the bracket opening and supports a lower side of the light supporter.

18. The appliance according to claim 17, wherein the lower side of the light supporter is in contact with an upper side of the first support portion, and wherein a rear side of the light supporter is in contact with a front side of the back cover.

19. The appliance according to claim 13, wherein the second support portion defines a coupling hole, wherein the lower bracket defines a bracket coupling hole facing the coupling hole, and wherein the door further comprising a coupling member that passes through the coupling hole and the bracket coupling hole and is inserted into the door body.

* * * * *